US007775964B2

(12) United States Patent
Miller, III

(10) Patent No.: US 7,775,964 B2
(45) Date of Patent: Aug. 17, 2010

(54) ACTIVE VIBRATION ATTENUATION FOR IMPLANTABLE MICROPHONE

(75) Inventor: Scott Allan Miller, III, Lafayette, CO (US)

(73) Assignee: Otologics LLC, Boulder, CO (US)

( * ) Notice: Subject to any disclaimer, the term of this patent is extended or adjusted under 35 U.S.C. 154(b) by 1245 days.

(21) Appl. No.: 11/330,788

(22) Filed: Jan. 11, 2006

(65) Prior Publication Data

US 2006/0155346 A1 Jul. 13, 2006

Related U.S. Application Data

(60) Provisional application No. 60/643,074, filed on Jan. 11, 2005, provisional application No. 60/740,710, filed on Nov. 30, 2005.

(51) Int. Cl.
*H04R 25/00* (2006.01)

(52) U.S. Cl. ..... 600/25

(58) Field of Classification Search ..... 600/25; 381/312–331, 71.1–71.7
See application file for complete search history.

(56) References Cited

U.S. PATENT DOCUMENTS

| | | | | |
|---|---|---|---|---|
| 4,443,666 | A | 4/1984 | Cote | 318/113 |
| 4,450,930 | A | 5/1984 | Killion | 181/129 |
| 4,504,703 | A | 3/1985 | Schneiter et al. | 181/163 |
| 4,532,930 | A | 8/1985 | Crosby et al. | 128/419 |
| 4,606,329 | A | 8/1986 | Hough | 128/1 |
| 4,607,383 | A | 8/1986 | Ingalls | 381/113 |
| 4,621,171 | A | 11/1986 | Wada et al. | 381/113 |
| 4,774,933 | A | 10/1988 | Hough et al. | 600/25 |
| 4,815,560 | A | 3/1989 | Madaffari | 181/129 |
| 4,837,833 | A | 6/1989 | Madaffari | 181/129 |
| RE33,170 | E | 2/1990 | Byers | 128/419 |
| 4,932,405 | A | 6/1990 | Peeters et al. | 128/419 |
| 4,936,305 | A | 6/1990 | Ashtiani et al. | 128/420.6 |
| 5,001,763 | A | 3/1991 | Moseley | |
| 5,015,224 | A | 5/1991 | Maniglia | 600/25 |
| 5,105,811 | A | 4/1992 | Kuzma | 128/420.6 |
| 5,163,957 | A | 11/1992 | Sade et al. | 623/10 |

(Continued)

FOREIGN PATENT DOCUMENTS

JP 2004048207 A 2/2004

OTHER PUBLICATIONS

Zenner H P et al: "Totally implantable hearing device for sensorineural hearing loss", Lancet The, Lancet Limited, vol. 352, No. 9142, p. 1751, Nov. 28, 1998.

*Primary Examiner*—John P Lacyk
(74) *Attorney, Agent, or Firm*—Marsh Fischmann & Breyfogle LLP

(57) ABSTRACT

The invention is directed to an implanted microphone having reduced sensitivity to vibration. In this regard, the microphone differentiates between the desirable and undesirable vibration by utilizing at least one motion sensor to produce a motion signal when an implanted microphone is in motion. This motion signal is used to yield a microphone output signal that is less vibration sensitive. In a first arrangement, the motion signal may be processed with an output of the implantable microphone transducer to provide an audio signal that is less vibration-sensitive than the microphone output alone. Specifically, the motion signal may be scaled to match the motion component of the microphone output such that upon removal of the motion signal from the microphone output, the remaining signal is an acoustic signal.

49 Claims, 11 Drawing Sheets

U.S. PATENT DOCUMENTS 5,176,620 A 1/1993 Gilman ..... 600/25
5,277,694 A 1/1994 Leysieffer et al. ..... 600/25
5,363,452 A 11/1994 Anderson ..... 381/170
5,402,496 A 3/1995 Soli et al. ..... 381/94.2
5,411,467 A 5/1995 Hortmann et al. ..... 600/25
5,456,654 A 10/1995 Ball ..... 600/25
5,475,759 A 12/1995 Engebretson ..... 381/318
5,500,902 A 3/1996 Stockham, Jr. et al. ..... 381/320
5,554,096 A 9/1996 Ball ..... 600/25
5,558,618 A 9/1996 Maniglia ..... 600/25
5,624,376 A 4/1997 Ball et al. ..... 600/25
5,680,467 A 10/1997 Hansen ..... 381/314
5,702,431 A 12/1997 Wang et al. ..... 607/61
5,749,912 A 5/1998 Zhang et al. ..... 607/57
5,754,662 A 5/1998 Jolly et al.
5,762,583 A 6/1998 Adams et al. ..... 600/25
5,795,287 A 8/1998 Ball et al. ..... 600/25
5,800,336 A 9/1998 Ball et al. ..... 600/ 25
5,814,095 A 9/1998 Muller et al. ..... 607/57
5,842,967 A 12/1998 Kroll ..... 600/25
5,848,171 A 12/1998 Stockham, Jr. et al. ..... 381/310
5,857,958 A 1/1999 Ball et al. ..... 600/25
5,859,916 A 1/1999 Ball et al. ..... 381/326
5,881,158 A 3/1999 Lesinski et al. ..... 381/174
5,888,187 A 3/1999 Jaeger et al. ..... 600/25
5,897,486 A 4/1999 Ball et al. ..... 600/25
5,906,635 A 5/1999 Maniglia ..... 607/57
5,912,977 A 6/1999 Gottschalk-Schoenig ... 381/321
5,913,815 A 6/1999 Ball et al. ..... 600/25
5,951,601 A 9/1999 Lesinski et al. ..... 623/10
6,031,922 A 2/2000 Tibbetts
6,044,162 A 3/2000 Mead et al. ..... 381/312
6,072,884 A 6/2000 Kates ..... 381/318
6,072,885 A 6/2000 Stockham, Jr. et al. ..... 381/321
6,097,823 A 8/2000 Kuo ..... 381/312
6,104,822 A 8/2000 Melanson et al. ..... 381/320
6,108,431 A 8/2000 Bachler ..... 381/312
6,128,392 A 10/2000 Leysieffer et al. ..... 381/318
6,134,329 A 10/2000 Gao et al. ..... 381/60
6,151,400 A 11/2000 Seligman ..... 381/317
6,163,287 A 12/2000 Huang ..... 341/143
6,173,063 B1 1/2001 Melanson ..... 381/318
6,198,971 B1 3/2001 Leysieffer ..... 607/55
6,330,339 B1 12/2001 Ishige et al. ..... 381/312
6,381,336 B1 4/2002 Lesinski et al. ..... 381/326
6,422,991 B1 7/2002 Jaeger ..... 600/25
6,626,822 B1 9/2003 Jaeger ..... 600/25
6,688,169 B2 2/2004 Choe et al. ..... 73/170.13
6,707,920 B2 3/2004 Miller ..... 381/326
6,736,771 B2 5/2004 Sokolich et al.
6,807,445 B2 10/2004 Baumann ..... 607/57
7,024,011 B1 4/2006 Hamacher et al.
7,214,179 B2 5/2007 Miller, III et al.
7,556,597 B2 * 7/2009 Miller et al. ..... 600/25

* cited by examiner

ACTIVE VIBRATION ATTENUATION FOR IMPLANTABLE MICROPHONE

CROSS REFERENCE TO RELATED APPLICATIONS

This application claims priority under 35 U.S.C. §119 to U.S. Provisional application 60/643,074 entitled "Active Vibration Attenuation For implantable Microphone" having a filing date of Jan. 11, 2005 and to U.S. Provisional Application U.S. Provisional 60/740,710 entitled "Active Vibration Attenuation For implantable Microphone" having a filing date of Nov. 30, 2005.

FIELD OF THE INVENTION

The present invention relates to implanted hearing instruments, and more particularly, to the reduction of undesired signals from an output of an implanted microphone.

BACKGROUND OF THE INVENTION

In the class of hearing aid systems generally referred to as implantable hearing instruments, some or all of various hearing augmentation componentry is positioned subcutaneously on, within, or proximate to a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and transducer, are located subcutaneously. In either arrangement, an implantable transducer is utilized to stimulate a component of the patient's auditory system (e.g., ossicles and/or the cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate, which causes the ossicular chain to stimulate the cochlea through its natural input, the so-called oval window.

As may be appreciated, a hearing instrument that proposes to utilize an implanted microphone will require that the microphone be positioned at a location that facilitates the receipt of acoustic signals. For such purposes, an implantable microphone may be positioned (e.g., in a surgical procedure) between a patient's skull and skin, for example, at a location rearward and upward of a patient's ear (e.g., in the mastoid region).

For a wearer a hearing instrument including an implanted microphone (e.g., middle ear transducer or cochlear implant stimulation systems), the skin and tissue covering the microphone diaphragm may increase the vibration sensitivity of the instrument to the point where body sounds (e.g., chewing) and the wearer's own voice, conveyed via bone conduction, may saturate internal amplifier stages and thus lead to distortion. Also, in systems employing a middle ear stimulation transducer, the system may produce feedback by picking up and amplifying vibration caused by the stimulation transducer.

Certain proposed methods intended to mitigate vibration sensitivity may potentially also have an undesired effect on sensitivity to airborne sound as conducted through the skin. It is therefore desirable to have a means of reducing system response to vibration (e.g., caused by biological sources and/or feedback), without affecting sound sensitivity. It is also desired not to introduce excessive noise during the process of reducing the system response to vibration. These are the goals of the present invention.

SUMMARY OF THE INVENTION

In order to achieve this goal, it is necessary to differentiate between the desirable case, caused by outside sound, of the skin moving relative to an inertial (non accelerating) implant housing, and the undesirable case, caused by bone vibration, of an implant housing and skin being accelerated by motion of the underlying bone, which will result in the inertia of the overlying skin exerting a force on the microphone diaphragm.

According to one aspect of the invention, differentiation between the desirable and undesirable cases is achieved by utilizing at least one motion sensor to produce a signal when an implanted microphone is in motion. Such a sensor may be, without limitation, an acceleration sensor and/or a velocity sensor. In any case, the signal is indicative movement of the implanted microphone diaphragm. In turn, this signal is used to yield a microphone output signal that is less vibration sensitive. The motion sensor(s) may be interconnected to an implantable support member for co-movement therewith. For example, such support member may be a part of an implantable microphone or part of an implantable capsule to which the implantable microphone is mounted.

In a first arrangement, the implantable microphone may comprise a microphone housing, an external diaphragm disposed across an aperture of the housing, and a microphone transducer interconnected to the microphone housing and operable to provide an output signal responsive to movement of the diaphragm. Such output signal may be supplied to an implantable stimulation transducer for middle ear, inner ear and/or cochlear implant stimulation. In this arrangement, the motion sensor(s) may be interconnected to the microphone housing and/or the microphone transducer for co-movement therewith. An example of a middle ear stimulation transducer arrangement is described in U.S. Pat. No. 6,491,622, hereby incorporated by reference.

In a second arrangement, the implanted microphone may be supportably interconnected within an opening of an implant capsule, wherein the external diaphragm is located to receive incident acoustic waves and a microphone transducer is hermetically sealed within the implant capsule. In this arrangement, the motion sensor(s) may be interconnected to the implant capsule for co-movement therewith. Such implant capsule may also hermetically house other componentry (e.g., processor and/or circuit componentry, a rechargeable energy source and storage device, etc.) and may provide one or more signal terminal(s) for electrical interconnection (e.g., via one or more cables) with an implantable stimulation transducer for middle ear or cochlear implant stimulation.

In either arrangement, the motion sensor(s) may be positioned such that an axis of sensitivity of the sensor is aligned with a principal direction of movement of the microphone diaphragm. Such a principal direction of movement may be substantially normal to a surface (e.g., a planar surface) defined by the diaphragm. Such alignment of the motion sensor may allow for enhanced detection of undesired movement between the diaphragm and overlying tissue (e.g., skin).

More preferably, such an axis of sensitivity may extend through the center of mass of the microphone. This may allow for more accurately identifying movement of the microphone as an assembly. Accordingly, the center of mass of the microphone assembly and motion sensor(s) may be located on a common axis that may also be directed normal to the principal direction of movement of the microphone diaphragm. In an arrangement where a plurality of motion sensor(s) is employed, the sensors may be positioned so that their centroid or combinative center of mass is located on such a common axis.

In another aspect utilizing a motion sensor to yield a microphone output signal that is less vibration sensitive, the output of the motion sensor may be processed with an output of the implantable microphone transducer to provide an audio signal that is less vibration-sensitive than the microphone output alone. For example, the motion sensor output may be appropriately scaled, phase shifted and/or frequency-shaped to match a difference in frequency response between the motion sensor output and the microphone transducer output, then subtracted from the microphone transducer output to yield a net, improved audio signal employable for driving a middle ear transducer, an inner ear transducer and/or a cochlear implant stimulation system.

In order to scale, frequency-shape and/or phase shift the motion sensor output, a variety of signal processing/filtering methods may be utilized. Mechanical feedback from an implanted transducer and other undesired signals, for example, those caused by biological sources, may be determined or estimated to adjust the phase/scale of the motion output signal. Such determined and/or estimated signals may be utilized to generate an output signal having a reduced response to the feedback and/or undesired signals. For instance, mechanical feedback may be determined by injecting a known signal into the system and measuring a feedback response at the motion sensor and microphone. By comparing the input signal and the feedback response a maximum gain for a transfer function of the system may be determined. Such signals may be injected to the system at the factory to determine factory settings. Further such signals may be injected after implant, e.g., upon activation of the hearing instrument. In any case, by measuring the feedback response using the motion sensor and removing the motion sensor response from the microphone response, the effects of such feedback may be reduced or substantially eliminated from the resulting net output.

By utilizing a filter to scale, frequency-shape and/or shift a motion sensor output response to mechanical feedback caused by an inserted signal, the magnitude and phase of the motion sensor response may be made to substantially match the microphone output response to the same mechanical feedback. Accordingly, by removing the 'filtered' motion sensor response from the microphone output response, the effects of mechanical feedback in the resulting net output may be substantially reduced. By generating a filter to manipulate the motion sensor output response to substantially match the microphone output response to mechanical feedback (e.g., caused by a known inserted signal), the filter may also be operative to manipulate the motion sensor output response to other undesired signals such as biological noise.

According to one aspect of the invention, a method and apparatus (i.e., utility) for generating a system model to match the output response of a motion sensor to the output response of a microphone is provided. The utility includes inserting a known signal into an implanted hearing device in order to actuate an auditory stimulation mechanism of the implanted hearing device. This may entail initiating the operation of an actuator/transducer. Operation of the auditory stimulation mechanism may generate vibrations that may be transmitted back to an implanted microphone via a tissue path (e.g., bone and/or soft tissue). These vibrations or 'mechanical feedback' are represented in the output response of the implanted microphone. Likewise, a motion sensor also receives the vibrations and generates an output response. The output responses of the implanted microphone and motion sensor are then sampled to generate a system model that is operative to match the motion sensor output response to the microphone output response. Once such a system model is generated, the system model may be implemented for use in subsequent operation of the implanted hearing device. That is, the matched response of the motion sensor may be removed from the output response of the implanted microphone to produce a net output response having reduced response to undesired signals (e.g., noise).

In one arrangement, the system model is generated using the ratios of the microphone and motion sensor output responses over a desired frequency range. For instance, a plurality of the ratios of the output responses may be determined over a desired frequency range. These ratios may then be utilized to create a mathematical model for adjusting the motion sensor output response to match the microphone output response for a desired frequency range. For instance, a mathematical function may be fit to the ratios of the output responses over a desired frequency range and this function may be implemented as a filter (e.g., a digital filter). The order of such a mathematical function may be selected to provide a desired degree of correlation between the function and the ratio of output responses. In any case, use of a second order or greater function may allow for non-linear adjustment of the motion sensor output response based on frequency. That is, the motion sensor output response may receive different scaling, frequency-shaping and/or phase shifting at different frequencies.

Variations exist in the implementation of such a system model. For instance, time domain samples or frequency domain samples of the microphone and motion sensor output responses may be utilized. In any case, upon generating a ratio of responses over a desired frequency range, a mathematical function may be fit to the ratio of responses and, if acceptable, implemented as a filter. Multiple known processes for fitting a function to such data exist. In one arrangement, the function comprises an IIR filter function. In such an arrangement, any appropriate method may be utilized selected coefficients for the IIR filter. Of note, when utilizing an IIR filter, the method may further entail monitoring the output values of the filter to identify instability. Upon identification of such instability, the filter coefficients may be reset to a predetermined starting value and/or reset to zero. Further, will be appreciated the multiple sets of filter coefficients may be established for a single IIR filter. In this regard, different filter coefficients may be utilized for different operating conditions. In such an arrangement, the filter may be adaptive to switch between or/or extrapolate between different coefficient sets.

Once a filter is established for matching the output response of the motion sensor to the output response of the microphone, the filtered motion sensor output may be combined with the microphone output response. This may result in the generation of a net output response of the microphone that has a reduced sensitivity to mechanical feedback as well as other sources of noise acting on both the microphone and a motion sensor.

One or more or all of the steps above may be performed by an internal processor of the implanted hearing instrument. In another arrangement, a portion of the steps may be performed external to the patient. For instance, the output responses of the microphone and the motion sensors may be transmitted (e.g., transcutaneously or via hard wiring) to an external processor (e.g., a PC) such that the modeling/generation of the system model may be performed external to the patient. Further, the system model may be validated prior to implementation within an implanted hearing instrument. If the system model performs adequately (exceeds one or more predetermined thresholds), the system model may be transmitted to the implanted hearing instrument (e.g., for storage in permanent/semi-permanent memory).

According to another aspect of the invention, a system and method (i.e., utility) are provided for use in an implantable hearing system. The method includes measuring first and second output responses of an implanted microphone and a motion sensor, respectively. The output responses are measured in response to a common stimulation. Ratio information is then generated that is associated with ratios of the first and second output responses. The ratio information may then be utilized to generate a relationship model of the first and second output responses. This model may be implemented as a filter to adjust subsequent output responses of at least one of the implanted microphone and/or the motion sensor.

Variations exist in the subject aspect. For instance, generating ratio information may include generating a plurality of time-based ratios and/or transforming the output responses of the implanted microphone and motion sensor to generate frequency domain output responses. According, such frequency domain responses may be utilized to generate ratio information. Typically, at least two ratios and more preferably a plurality of ratios of the first and second output responses (e.g., over a plurality of desired frequency ranges) are utilized to generate the ratio information associated with the first and second output responses.

Producing a model may include utilizing individual ratios for individual frequency bands or, producing a function that (e.g., a nonlinear function) substantially matches the ratio information over a desired frequency range. In one arrangement, this includes fitting a digital filter function to the ratio information over a predetermined frequency range. In such an arrangement, multiple sets of filter coefficients may be selected for the digital filter function. For instance, a first set of coefficients may correspond to a first relationship model of the first and second output responses to a first common stimulation. A second set of coefficients may correspond to a second relationship model of the first and second output responses to a second different common stimulation. The method may further including selectively switching between different sets of filter coefficients based on current operating parameters of the hearing system.

According to another aspect of the present invention, a system and method for use in an implantable hearing system is provided. The system and method (i.e., utility) includes measuring first and second outputs of an implanted microphone and a motion sensor, respectively, in response to the operation of an implanted auditory stimulation device. The first and second outputs are utilized to calibrate a digital filter such that transfer function of the digital filter may be utilized to adjust one of the first and second outputs to be substantially equal the other of the first and second outputs. Accordingly, the digital filter may be utilized to filter subsequent outputs for noise cancellation purposes.

In order to calibrate the digital filter, the frequency responses of the motion sensor and implanted microphone are measured in response to operation of an implanted auditory stimulation device. In this regard, the first output may measure a feedback transmitted through a first tissue path between an implanted auditory stimulation device and the implanted microphone while the second output may measure feedback transmitted through a second tissue path between the implanted auditory stimulation device and the motion sensor. In one arrangement, the first and second tissue paths may be substantially the same where the motion sensor and implanted microphone are substantially co-located.

In any case, once the digital filter is implemented to filter subsequent outputs of one of the motion sensor and the microphone output, the digital filter may generate filtered outputs. Accordingly, the filtered outputs may be combined with a non-filtered output to generate net outputs. Such net outputs may have reduced response to undesired signals.

According to another aspect of the present invention, a system and method (i.e., utility) is provided for use in an implantable hearing system. The method includes measuring first and second output responses of an implanted microphone and motion sensor, respectively, to a common stimulation source. First and second ratios of the first and second output response are generated for first and second frequency ranges, respectively. These first and second ratios are then utilized to adjust subsequent output responses of one of the motion sensor and implanted microphone for the first and second frequency ranges. In a further arrangement, a plurality of ratios of the first and second output responses are produced for plurality of frequency ranges. As may be appreciated, by increasing the number of frequency ranges, the output response of one of the implanted microphone and motion sensor may be better matched to the output of the other of the microphone and motion sensor. Such processing may be performed in a sub-band processing system.

According to another aspect of the present invention, an implantable hearing system that is operative to match an output response of a motion sensor to at least a portion of an output response of an implanted microphone is provided. The system includes a microphone that is adapted for subcutaneous positioning and which is operative to receive signals including motion/acceleration and acoustic components. The microphone is further operative to generate microphone output responses that include the motion/acceleration and acoustic components. The system further includes a motion sensor that is operative to receive signals including motion/acceleration components and generate motion sensor output responses. Such motion sensor output responses may be substantially free of acoustic components. The system further includes a digital filter that is adapted to utilize a ratio of the microphone output responses and motion sensor output responses to generate a transfer function. The digital filter is then operative to apply the transfer function to the motion sensor output and/or the microphone output responses to produce filtered output responses. A summation device is then utilized to combine filtered output responses to one of the microphone output response and the motion sensor output responses to generate net output responses. Finally, an implantable auditory stimulation device is operative to stimulate an auditory component of a patient in accordance with the net output response.

As may be appreciated, variations exist to the components of the present system. For instance, the system may include one or more A to D converters to convert analog output signals of the motion sensor and microphone to digital signals. Likewise, the system may include one or more D to A converters for converting digital output signals to analog drive signals that are operative to actuate the implantable auditory stimulation device. In one arrangement, the auditory stimulation device may be a mechanical actuator for physically stimulating an auditory component.

In another aspect of the present invention, an implantable hearing system and method (i.e., utility) utilizes first and second control loops for controlling the amount of noise (e.g., feedback and/or biological noise) in the output of the implanted microphone prior to processing. In this aspect, a first control loop includes a motion sensor for detecting acceleration within the system. An output response of this motion sensor may be removed from an output response to the microphone to reduce biological noise as well as mechanical feedback, which may be present due to the operation of an implanted auditory stimulation device. In this regard, the output response to the motion sensor may be filtered to adjust its magnitude and/or phase. However, this may result in amplification of electrical noise associated with the motion sensor. Accordingly, in quiet operating conditions a user of the implantable hearing system may experience enhanced noise due to amplification of electrical noise in the motion sensor output. To address this problem, the utility utilizes a second control loop. The second control loop utilizes a filter to match the digital output of a digital signal processor of the implanted hearing system to the mechanical feedback path. In this regard, the digital output of the digital signal processor is scaled and or phase shifted removed from the microphone output response and then reinserted into the digital signal processor. In this control loop, there is no electrical noise as all signals are digital. Accordingly, in quite operating conditions (e.g., low ambient noise environments) use of the second control loop may be preferred. However, the second control loop while being effective to reduce mechanical feedback within the microphone output response, it may be ineffective for removing other sources of noise (e.g., biological) in the microphone output response. Accordingly, it may be desirable in instances where other sources of noise exist to utilize the first control loop.

Accordingly, the utility is operative to select between and/or blend the outputs of the first and second control loops based on current operating conditions in order to reduce noise perceived by a user of the implantable hearing system. In one arrangement, the utility is operative to select the control loop signal having a lower magnitude and hence the lower noise component. In further arrangements, such as sub-band processing arrangements, different control loops may be utilized for different frequency ranges. In this regard, the control loop that provides the best noise cancellation for a predetermined frequency range may be utilized.

In a further arrangement for removing undesired signals caused by biological sources, one or more adaptive filtering techniques may be utilized. As will be noted, biological signals are not generally constant over time. Accordingly, the system may use an adaptive algorithm to adjust an adaptive filter in order to remove undesired signals. Illustrative adaptive algorithms include, without limitation, stochastic gradient-based algorithms such as the least-mean-squares (LMS) and recursive algorithms such as recursive least-squares (RLS).

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
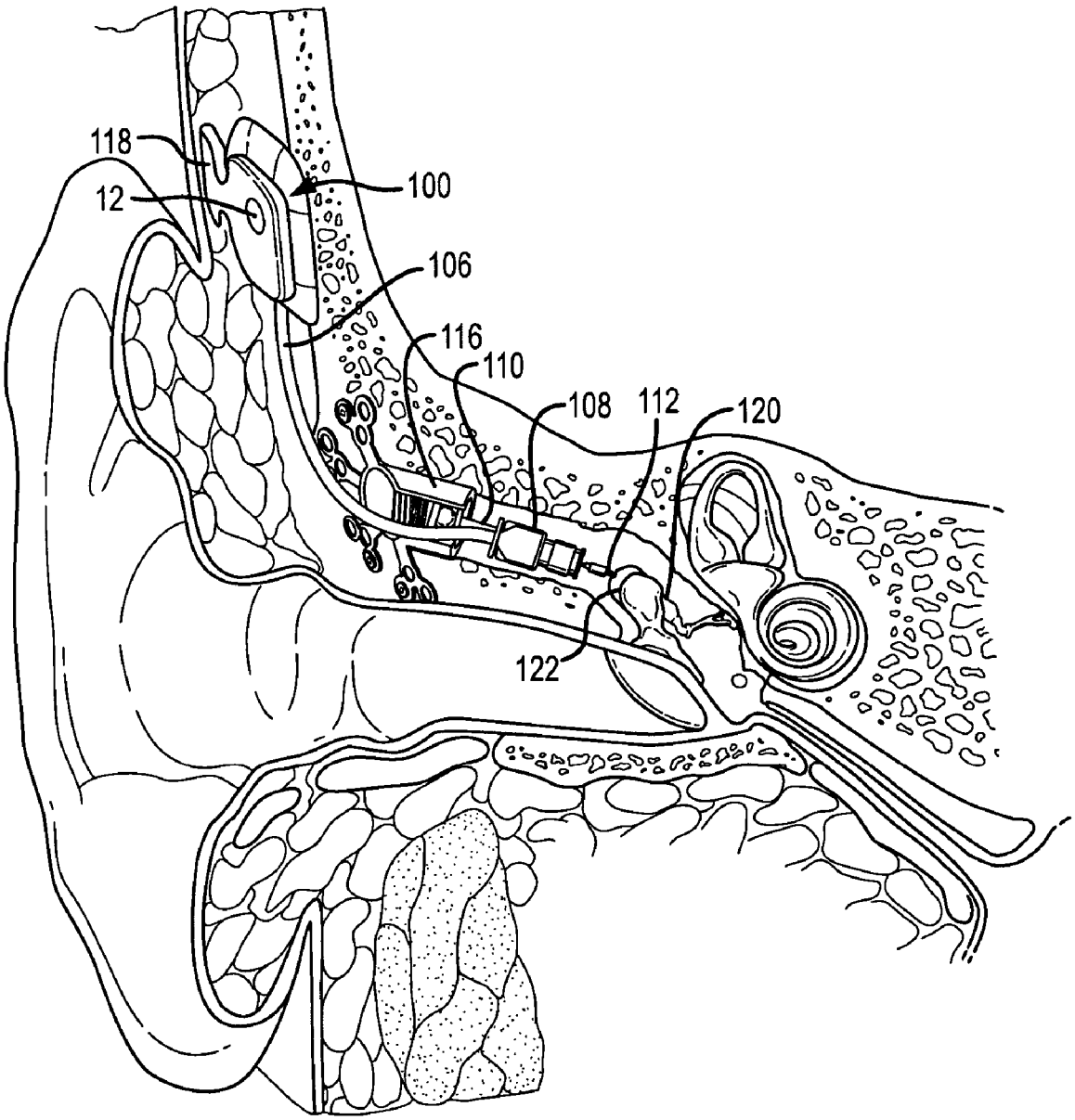
FIG. 1 illustrates a fully implantable hearing instrument as implanted in a wearer's skull.

FIG. 1 illustrates one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, a biocompatible implant capsule 100 is located subcutaneously on a patient's skull. The implant capsule 100 includes a signal receiver 118 (e.g., comprising a coil element) and a microphone diaphragm 12 that is positioned to receive acoustic signals through overlying tissue. The implant housing 100 may further be utilized to house a number of components of the fully implantable hearing instrument. For instance, the implant capsule 100 may house an energy storage device, a microphone transducer, and a signal processor. Various additional processing logic and/or circuitry components may also be included in the implant capsule 100 as a matter of design choice. Typically, a signal processor within the implant capsule 100 is electrically interconnected via wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

During normal operation, ambient acoustic signals (i.e., ambient sound) impinge on patient tissue and are received transcutaneously at the microphone diaphragm 12. Upon receipt of the transcutaneous signals, a signal processor within the implant capsule 100 processes the signals to provide a processed audio drive signal via wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

Upon operation of the transducer 108, vibrations are applied to the incus 122, however, such vibrations are also applied to the bone anchor 116. The vibrations applied to the bone anchor are likewise conveyed to the skull of the patient from where they may be conducted to the implant capsule 100 and/or to tissue overlying the microphone 10. Accordingly such vibrations may be applied to the microphone diaphragm 12 and thereby included in the output response of the microphone 10. Stated otherwise, mechanical feedback from operation of the transducer 108 may be received by the implanted microphone diaphragm 12 via a feedback loop formed through tissue of the patient. Further, application of vibrations to the incus 122 may also vibrate the eardrum thereby causing sound pressure waves which may pass through the ear canal where they may be received by the implanted microphone diaphragm 12 as ambient sound. Further, biological sources may also cause vibration (e.g., biological noise) to be conducted to the implanted microphone through the tissue of the patient. Such biological sources may include, without limitation, vibration caused by speaking, chewing, movement of patient tissue over the implant microphone (e.g. caused by the patient turning their head), and the like.

Figure 2:
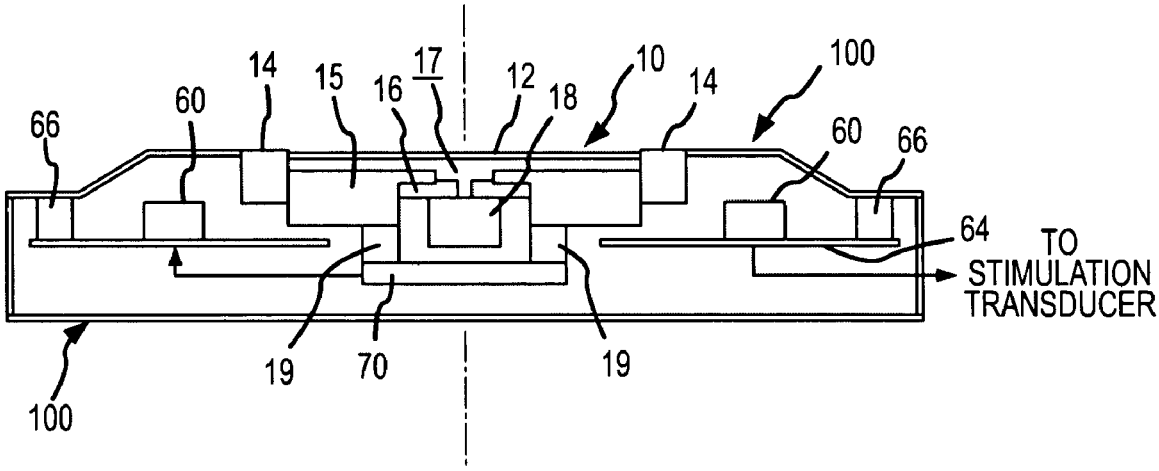
FIG. 2 is a schematic, cross-sectional illustration of one embodiment of the present invention.

FIG. 2 shows one embodiment of an implantable microphone 10 that utilizes a motion sensor 70 to reduce the effects of noise, including mechanical feedback and biological noise, in an output response of the implantable microphone 10. As shown, the microphone 10 is mounted within an opening of the implant capsule 100. The microphone 10 includes an external diaphragm 12 (e.g., a titanium membrane) and a housing having a surrounding support member 14 and fixedly interconnected support members 15, 16, which combinatively define a chamber 17 behind the diaphragm 12. The microphone 10 may further include a microphone transducer 18 that is supportably interconnected to support member 15 and interfaces with chamber 17, wherein the microphone transducer 18 provides an electrical output responsive to vibrations of the diaphragm 12. The microphone transducer 18 may be defined by any of a wide variety of electroacoustic transducers, including for example, capacitor arrangements (e.g., electret microphones) and electrodynamic arrangements.

One or more processor(s) and/or circuit component(s) 60 and an on-board energy storage device (not shown) may be supportably mounted to a circuit board 64 disposed within implant capsule 100. In the embodiment of FIG. 2, the circuit board is supportably interconnected via support(s) 66 to the implant capsule 100. The processor(s) and/or circuit component(s) 60 may process the output signal of microphone transducer 18 to provide a drive signal to an implanted transducer. The processor(s) and/or circuit component(s) 60 may be electrically interconnected with an implanted, inductive coil assembly (not shown), wherein an external coil assembly (i.e., selectively locatable outside a patient body) may be inductively coupled with the inductive coil assembly to recharge the on-board energy storage device and/or to provide program instructions to the processor(s), etc.

Vibrations transmitted through the skull of the patient cause vibration of the implant capsule 100 and microphone 10 relative to the skin that overlies the microphone diaphragm 12. Movement of the diaphragm 12 relative to the overlying skin may result in the exertion of a force on the diaphragm 12. The exerted force may cause undesired vibration of the diaphragm 12, which may be included in the electrical output of the transducer 18 as received sound. As noted above, two primary sources of skull borne vibration are feedback from the implanted transducer 108 and biological noise. In either case, the vibration from these sources may cause undesired movement of the microphone 10 and/or movement of tissue overlying the diaphragm 12.

To actively address such sources of vibration and the resulting undesired movement between the diaphragm 12 and overlying tissue, the present embodiment includes a motion sensor 70 that provides an output response proportional to the vibrational movement experienced by the implant capsule 100 and, hence, the microphone 10. Generally, the motion sensor 70 may be mounted anywhere within the implant capsule 100 and/or to the microphone 10 that allows the sensor 70 to provide an accurate representation of the vibration received by the implant capsule 100, microphone 10, and/or diaphragm 12. In a further arrangement (not shown), the motion sensor may be a separate sensor that may be mounted to, for example, the skull of the patient. What is important is that the motion sensor 70 is substantially isolated from the receipt of the ambient acoustic signals that pass transcutaneously through patient tissue and which are received by the microphone diaphragm 12. In this regard, the motion sensor 70 may provide an output response/signal that is indicative of motion (e.g., caused by vibration and/or acceleration) whereas the microphone transducer 18 may generate an output response/signal that is indicative of both transcutaneously received acoustic sound and motion. Accordingly, the output response of the motion sensor may be removed from the output response of the microphone to reduce the effects of motion on the implanted hearing system.

The motion sensor 70 may include one or more directions or "axes" of motion sensitivity. In this regard, the motion sensor 70 may monitor motion in a single axis or in multiple axes (e.g., three axes). Further, the motion sensor 70 may be located such that at least one axis of sensitivity of the motion sensor 70 is aligned with the principle direction of movement of the diaphragm 12. That is, at least one axis of sensitivity of the accelerometer 70 may be located such that it is sensitive to movement normal to the surface of the diaphragm 12. For instance, one axis of sensitivity may pass through a center of mass of the microphone assembly 10. In this regard, the movement of the microphone assembly 10 in the direction most likely to result in undesired vibration within the diaphragm 12 may be more accurately monitored. As may be appreciated, multiple motion sensors may be employed in the embodiments with corresponding analogous mounting arrangements to that shown for the motion sensor 70 in the given embodiment.

The motion sensor output response is provided to the processor(s) and/or circuit component(s) 60 for processing together with the output response from microphone transducer 18. More particularly, the processor(s) and/or circuit component(s) 60 may scale and frequency-shape the motion sensor output response to vibration (e.g., filter the output) to match the output response of the microphone transducer to vibration 18 (hereafter output response of the microphone). In turn, the scaled, frequency-shaped motion sensor output response may be subtracted from the microphone output response to produce a net audio signal or net output response. Such a net output response may be further processed and output to an implanted stimulation transducer for stimulation of a middle ear component or cochlear implant. As may be appreciated, by virtue of the arrangement of the FIG. 2 embodiment, the net output response will reflect reduced sensitivity to undesired signals caused by vibration (e.g., resulting form mechanical feedback and/or biological noise).

Figure 3:
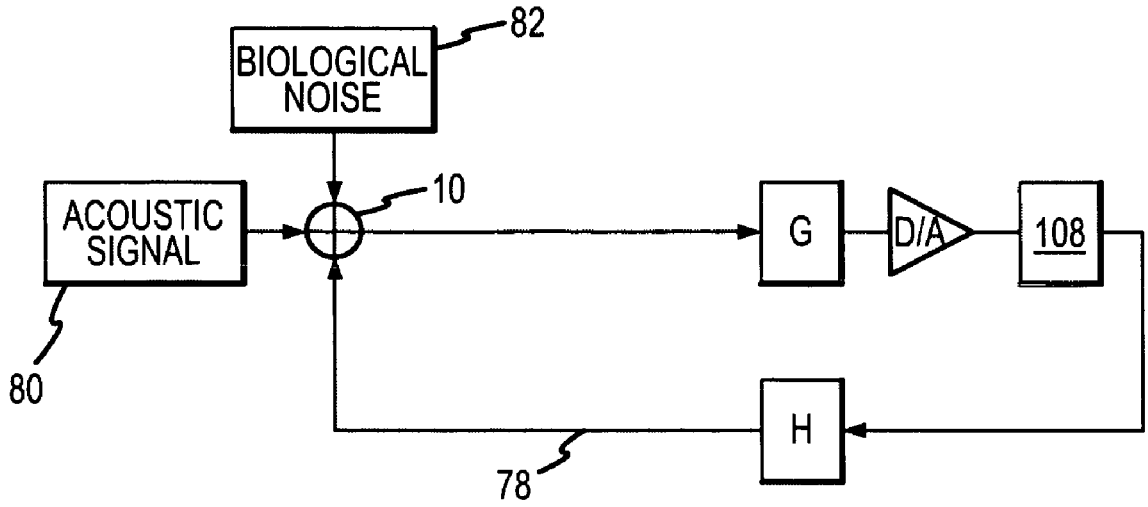
FIG. 3 illustrates an ambient sound source, biological noise source and feedback noise source applied to an implanted microphone.

FIG. 3 schematically illustrates the combined application of acoustic signals, biological noise, and mechanical feedback to the microphone 10. The microphone 10 is subjected to and effectively combines these signals. That is, the microphone combines desired acoustic signals 80 (i.e., ambient sound) as well as undesired signals such as signals that may be from one or more biological source(s) 82 (i.e., vibration caused by talking, chewing etc.) and mechanical feedback from the transducer 108. In the latter regard, operation of the transducer 108 generates vibrations that may be carried to the microphone 10 via a tissue path in what is termed a feedback loop 78. Accordingly, the output response of the microphone 10 is a combination of desired signals and undesired signals. However, the proportion of desired signals to undesired signals is unknown.

The biological source 82 and feedback loop 78 in the system can be modeled as shown in FIG. 3. As noted, the biological source 82 is due to vibration of the surrounding and supporting tissue being vibrated by, for example, chewing or speech activities and is present in all implanted microphones. The feedback loop 78 is present in all implanted hearing systems that use a mechanical or acoustical output, such as middle ear implants. Block G represents the transfer function through the speech processor to the output transducer 108, such as the Otologics Middle Ear Ossicular Stimulator (MET). Block H represents mechanical feedback from the transducer 108 to tissue and, ultimately, to the microphone 10 which, as shown, receives acoustic signals (i.e., desired signals), signals from the biological source (e.g., biological noise) and feedback from the transducer. It is desired to minimize the biological noise, which may otherwise present very loud signals to the patient. It is also desired to prevent the feedback loop from oscillating, or in fact being close to oscillation.

Given H, it is possible to determine the maximum allowed value of the transfer function G using one or more methods. These methods are, for example, associated with the names of Bode and Nyquist. Such techniques are also found embodied in software tools such as the MATLAB System Identification toolbox. The problem is one of determining H without degrading the performance of the system during operation. It has been found that the signal impressed by the biological noise or by H (e.g., mechanical feedback) on the microphone assembly 10 is directly proportional to the acceleration of the microphone 10 and the mass per unit area of the overlying tissue (e.g., on the microphone 10). Thus, if the acceleration is measured and effectively reduced to zero, the impairment in the microphone pickup will be substantially reduced or eliminated. The following descriptions are meant to illustrate, but are not meant to exclude any additional techniques. In the discussion that follows, for instance, the acceleration of the microphone is measured by a "motion sensor", however, it will be appreciated that the term motion sensor may include accelerometers, vibration sensors, velocity sensors and displacement sensors.

Figure 4:
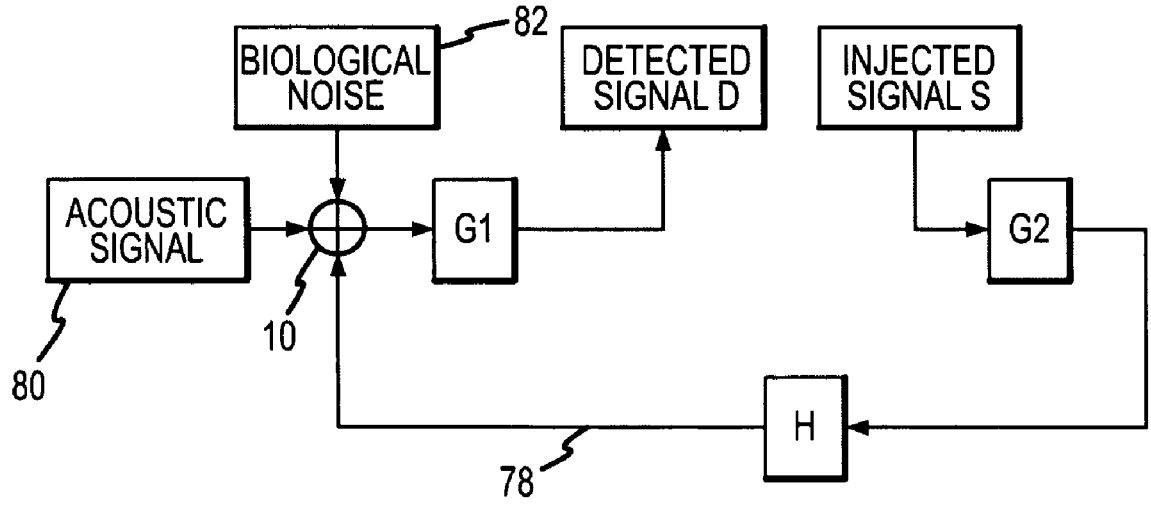
FIG. 4 illustrates signal injection in an implantable hearing aid for determining transducer feedback.

If H is not known, the problem becomes more difficult, but is also known to those skilled in the art as system identification or modeling. See, for instance, "System identification for self-adaptive control" by Davies, W. D. T. As an example, if H is stable, it may be possible to inject a signal into the system and determine the value of H, as shown in FIG. 4. In this embodiment, a signal S is injected (e.g., to actuate the transducer 108), and the output D is subsequently determined. The ratio D/(G2*G1*S) is then H. Various forms of injected signal have been used for system identification by those skilled in the art, but include pulses, clicks, steps, single tones, multitones, limited amplitude wideband, swept sines, random, pseudorandom signals, maximum length sequences (MLS), Golay codes, etc. The choice here is one of what frequencies need to be measured, required accuracy, available signal to noise ratio (including the quantization noise of the A/D, numerical processing and D/A), and allowed measurement time. Using large amplitude signals with fewer frequency components will result in shorter acquisition times, and thus system identification can be performed in a few seconds. Smaller amplitude signals distributed over a wider number of frequencies require longer averaging times. In one particular embodiment, using an MLS as the source allows data collected in a fraction of a second. Other possible sources of excitation for system identification are the naturally occurring background from biological noise, and/or the vibrations induced by the transducer during normal processing of acoustic inputs, which in turn generate vibrations A high amplitude signal may be injected at the factory, or during the time of surgical implantation. Further, a moderately high amplitude signal can be injected every time the user initializes the hearing instrument or at other scheduled times. It has been found that, as a suitable amplitude MLS signal is distributed over a wide frequency band with no large concentrations of power at any one frequency and needs only be applied for a fraction of a second, relatively large net power levels are well-tolerated by patients. As illustrated in FIG. 4, the signal can be injected by breaking the feedback, which would necessitate cessation of normal operation, but it is also possible to additively inject a signal, adjusting G2*G1 so as to be equal to G, and effectively keep the original signal processing in place. Known techniques exist to extract the value of H from the injected signal and the signal immediately before the injection point. If enough signal processing time is available, a wideband, small amplitude signal can be added into the loop which is below the users threshold of hearing. This allows the value of H to be continuously monitored. The detection process can be time domain, use Fourier transforms such as FFTs, DFTs, etc., or may be based on polyphase filters, correlation, etc.

Figure 5:
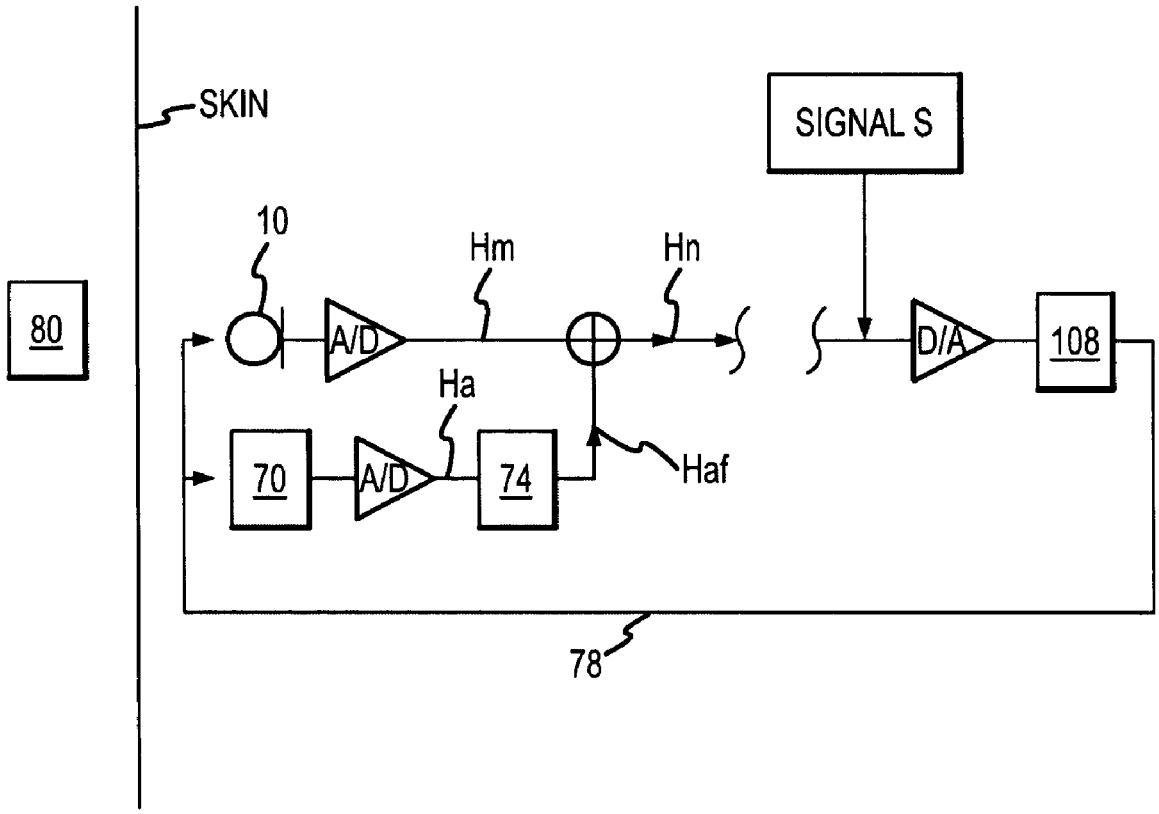
FIG. 5 is a schematic illustration of an implantable microphone incorporating a motion sensor.

Techniques such as placing an internal feedback loop of the same magnitude as G1 G2 H but of opposite phase to cancel out G1 G2 H remove the effects of feedback oscillation, but do not remove the effect of biological noise, as such techniques measure H but not the size of the acceleration. Accordingly, to remove biological noise, it is necessary to measure the acceleration of the microphone 10. FIG. 5 schematically illustrates an implantable hearing system that incorporates an implantable microphone 10 and motion sensor 70. As shown, the motion sensor 70 further includes a filter 74 that is utilized for matching the output response Ha of the motion sensor 70 to the output response Hm of the microphone assembly 10. Of note, the microphone 10 is subject to desired acoustic signals (i.e., from an ambient source 80), as well as undesired signals from biological sources (e.g., vibration caused by talking, chewing etc.) and feedback from the transducer 108 received by a tissue feedback loop 78. In contrast, the motion sensor 70 is substantially isolated from the ambient source and is subjected to only the undesired signals caused by the biological source and/or by feedback received via the feedback loop 78. Accordingly, the output of the motion sensor 70 corresponds the undesired signal components of the microphone 10. However, the magnitude of the output channels (i.e., the output response Hm of the microphone 10 and output response Ha of the motion sensor 70) may be different and/or shifted in phase. In order to remove the undesired signal components from the microphone output response Hm, the filter 74 and/or the system processor may be operative to filter one or both of the responses to provide scaling, phase shifting and/or frequency shaping. The output responses Hm and Ha of the microphone 10 and motion sensor 70 are then combined by summation unit 76, which generates a net output response Hn that has a reduced response to the undesired signals.

In order to implement a filter 74 for scaling and/or phase shifting the output response Ha of a motion sensor 70 to remove the effects of feedback and/or biological noise from a microphone output response Hm, a system model of the relationship between the output responses of the microphone 10 and motion sensor 70 must be identified/developed. That is, the filter 74 must be operative to manipulate the output response Ha of the motion sensor 70 to biological noise and/or feedback, to replicate the output response Hm of the microphone 10 to the same biological noise and/or feedback. In this regard, the output responses Ha and Hm to a common noise source (e.g., biological noise and/or feedback) may be of substantially the same magnitude and phase prior to combination (e.g., subtraction/cancellation). However, it will be noted that such a filter 74 need not manipulate the output response Ha of the motion sensor 70 to match the microphone output response Hm for all operating conditions. Rather, the filter 74 needs to match the output responses Ha and Hm s over a predetermined set of operating conditions including, for example, a desired frequency range (e.g., an acoustic hearing range) and/or one or more pass bands. Note also that the filter 74 need only accommodate the ratio of microphone output response Hm to the motion sensor output response Ha to acceleration, and thus any changes of the feedback path which leave the ratio of the responses to acceleration unaltered have little or no impact on good cancellation. Such an arrangement thus has significantly reduced sensitivity to the posture, clenching of teeth, etc., of the patient.

Figure 6:
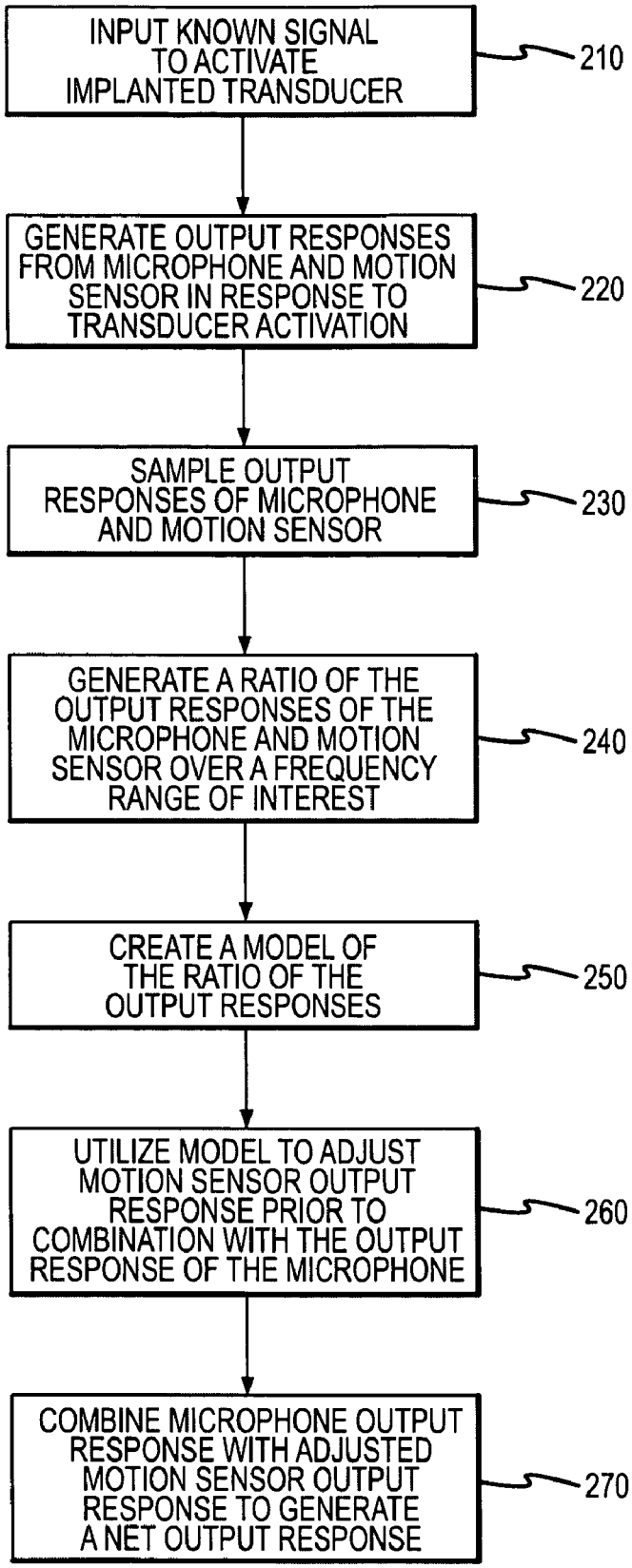
FIG. 6 is a process flow sheet.

Referring to FIGS. 5-10, a method is provided for implementing a digital filter for removing undesired signals from an output of an implanted microphone 10. As will be appreciated, a digital filter is effectively a mathematical manipulation of set of digital data to provide a desired output. Stated otherwise, the digital filter 74 may be utilized to mathematically manipulate the output response Ha of the motion sensor 70 to match the output response Hm of the microphone 10. FIG. 6 illustrates a general process 200 for use in generating a model to mathematically manipulate the output response Ha of the motion sensor 70 to replicate the output response Hm of the microphone 10 for a common stimulus. Specifically, in the illustrated embodiment, the common stimulus is feedback caused by the actuation of an implanted transducer 108. To better model the output responses Ha and Hm, it is generally desirable that little or no stimulus of the microphone 10 and/or motion sensor 70 occur from other sources (e.g., ambient or biological) during at least a portion of the modeling process.

Initially, a known signal S (e.g., a MLS signal) is input (210) into the system to activate the transducer 108. This may entail inputting (210) a digital signal to the implanted capsule and digital to analog (D/A) converting the signal for actuating of the transducer 108. Such a drive signal may be stored within internal memory of the implantable hearing system, provided during a fitting procedure, or generated (e.g., algorithmically) internal to the implant during the measurement. Alternatively, the drive signal may be transcutaneously received by the hearing system. In any case, operation of the transducer 108 generates feedback that travels to the microphone 10 and motion sensor 70 through the feedback path 78. The microphone 10 and the motion sensor 70 generate (220) responses, Hm and Ha respectively, to the activation of the transducer 108. These responses (Ha and Hm) are sampled (230) by an A/D converter (or separate A/D converters). For instance, the actuator 108 may be actuated in response to the input signal(s) for a short time period (e.g., a quarter of a second) and the output responses may be each be sampled (230) multiple times during at least a portion of the operating period of the actuator. For example, the outputs may be sampled (230) at a 16000 Hz rate for one eighth of a second to generate approximately 2048 samples for each response Ha and Hm. In this regard, data is collected in the time domain for the responses of the microphone (Hm) and accelerometer (Ha).

Figure 7:
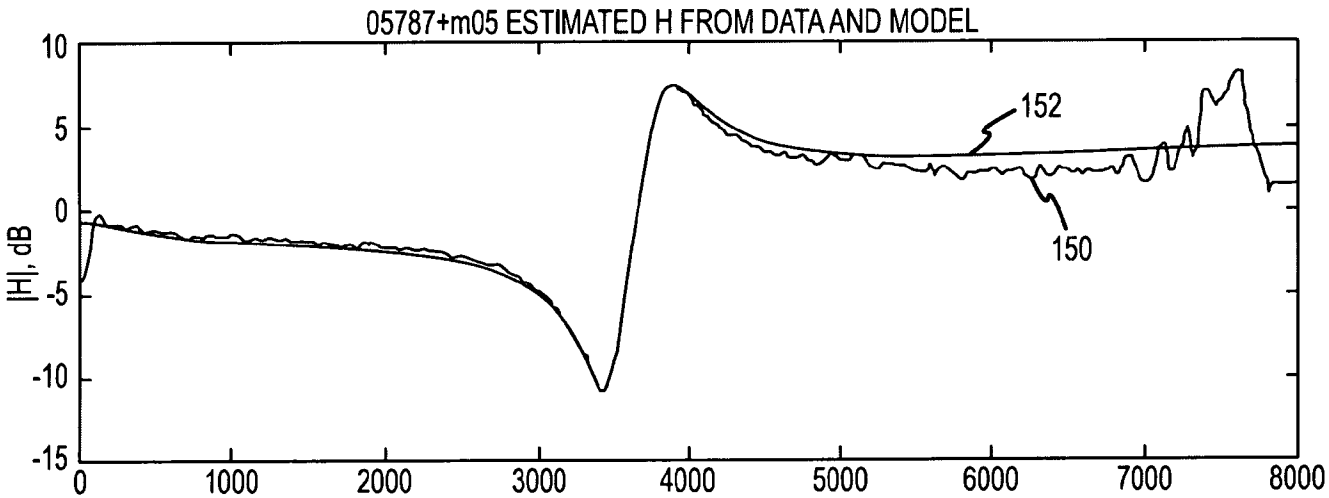
FIG. 7 is a plot of the ratios of the magnitudes of output responses of an implanted microphone and motion sensor.
Figure 8:
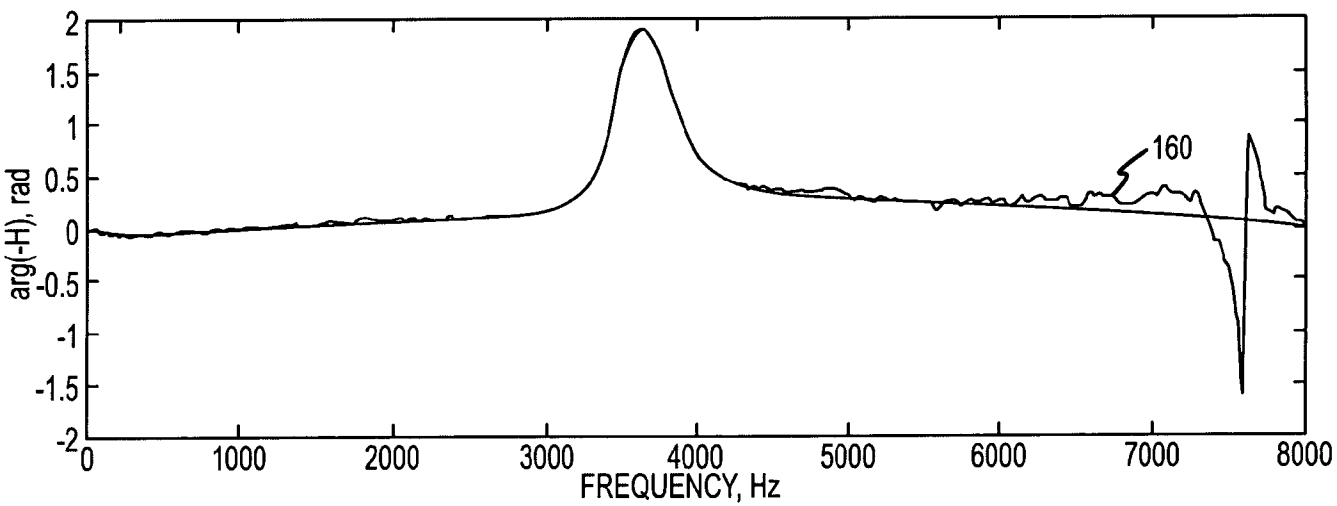
FIG. 8 is a plot of the ratios of the phases of output responses of an implanted microphone and motion sensor.

The time domain output responses of the microphone and accelerometer may be utilized to create a mathematical model between the responses Ha and Hm. In another embodiment, the time domain responses are transformed into frequency domain responses. For instance, each spectral response is estimated by non-parametric (Fourier, Welch, Bartlett, etc.) or parametric (Box-Jenkins, state space analysis, Prony, Shanks, Yule-Walker, instrumental variable, maximum likelihood, Burg, etc.) techniques. A plot of the ratio of the magnitudes of the transformed microphone response to the transformed accelerometer response over a frequency range of interest may then be generated (240). FIG. 7 illustrates the ratio of the output responses of the microphone 10 and motion sensor 70 using a Welch spectral estimate. As shown, the jagged magnitude ratio line 150 represents the ratio of the transformed responses over a frequency range between zero and 8000 Hz. Likewise, a plot of a ratio of the phase difference between the transformed signals may also be generated as illustrated by FIG. 8, where the jagged line 160 represents the ratio of the phases the transformed microphone output response to the transformed motion sensor output response. It will be appreciated that similar ratios may be obtained using time domain data by system identification techniques followed by spectral estimation.

The plots of the ratios of the magnitudes and phases of the microphone and motion sensor responses Hm and Ha may then be utilized to create (250) a mathematical model (whose implementation is the filter) for adjusting the output response Ha of the motion sensor 70 to match the output response Hm of the microphone 10. Stated otherwise, the ratio of the output responses provides a frequency response between the motion sensor 70 and microphone 10 and may be modeled create a digital filter. In this regard, the mathematical model may consist of a function fit to one or both plots. For instance, in FIG. 7, a function 152 may be fit to the magnitude ratio plot 150. The type and order of the function(s) may be selected in accordance with one or more design criteria, as will be discussed herein. Normally complex frequency domain data, representing both magnitude and phase, are used to assure good cancellation. Once the ratio(s) of the responses are modeled, the resulting mathematical model may be implemented as the digital filter 74. As will be appreciated, the frequency plots and modeling may be performed internally within the implanted hearing system, or, the sampled responses may be provided to an external processor (e.g., a PC) to perform the modeling.

Once a function is properly fitted to the ratio of responses, the resulting digital filter may then be utilized (260) to manipulate (e.g., scale and/or phase shift) the output response Ha of the motion sensor prior to its combination with the microphone output response Hm. The output response Hm of the microphone 10 and the filtered output response Haf of the motion sensor may then be combined (270) to generate a net output response Hn (e.g., a net audio signal). However, it may be desirable to test the effectiveness of the digital filter prior to its use under normal operating conditions. This is analogous to "validating" a prescription in a hearing instrument on an analyzer before activating the hearing instrument on a patient, reduces potential annoyance of the patient, and confirms that the right parameters are selected for this stage of the fitting.

Figure 9:
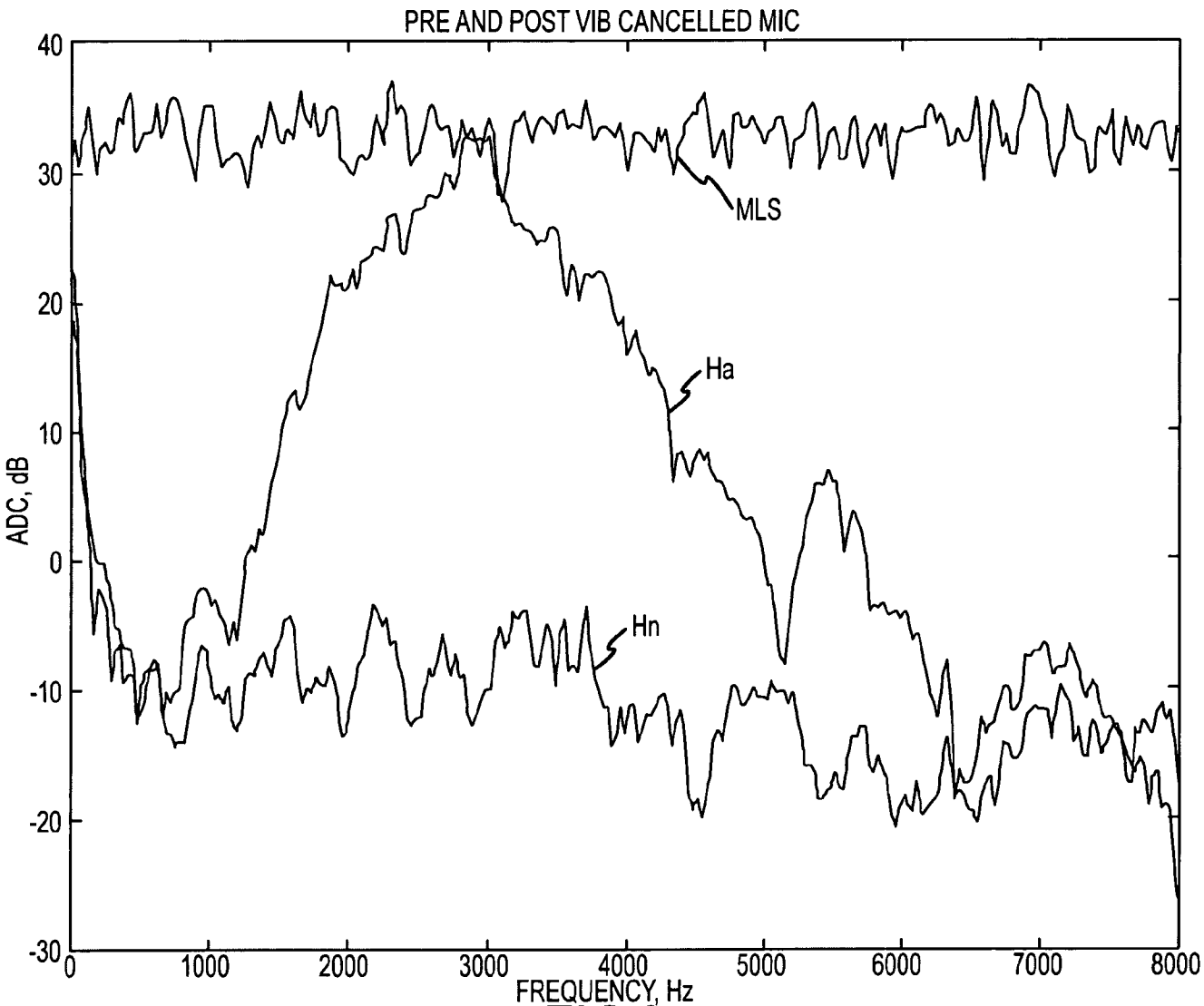
FIG. 9 is a plot of cancelled and non-cancelled outputs of an implanted microphone.

To test the effectiveness of the filter 74, the same input signal or a different input signal may be applied to the transducer 108. In this instance, the output response Hm of the microphone may again be measured as well as the net output response Hn (i.e., the cancelled signal). A determination is then made as to the effectiveness of the digital filter for removing undesired signal components form the microphone output. For instance FIG. 9 illustrates a comparison between a non-cancelled signal (i.e., a microphone output response Ha) and a cancelled signal (i.e., a net output response Hn). As shown, the microphone output response Hm is compared to a maximum expected response, which in this instance is the MLS drive signal prior to digital to analog conversion and insertion into the transducer 108.

As shown in FIG. 9, the distance between the MLS drive signal and the microphone output responses, Hm and Hn, corresponds to the amount of gain that may be applied to the microphone output response at each frequency between 0 Hz and 8000 Hz. Specifically, the uncancelled microphone output response Hm may be amplified over its frequency range to a magnitude just below the magnitude of the MLS drive signal without causing oscillation within the system. As shown, prior to cancellation the microphone output response Hm experiences significant feedback caused by operation of the transducer 108 over a frequency range between about 1200 Hz and about 5200 Hz. That is, the output response Hm of the microphone over this frequency range is significantly affected by the operation of the implantable transducer 108. Of particular note, at about 3000 Hz the microphone output response Ha meets and or exceeds the MLS drive signal. At this peak feedback frequency, a user of the implantable device may notice a ringing cause by an oscillation in the system, and would not be able to achieve any useful functional gain.

Figure 10:
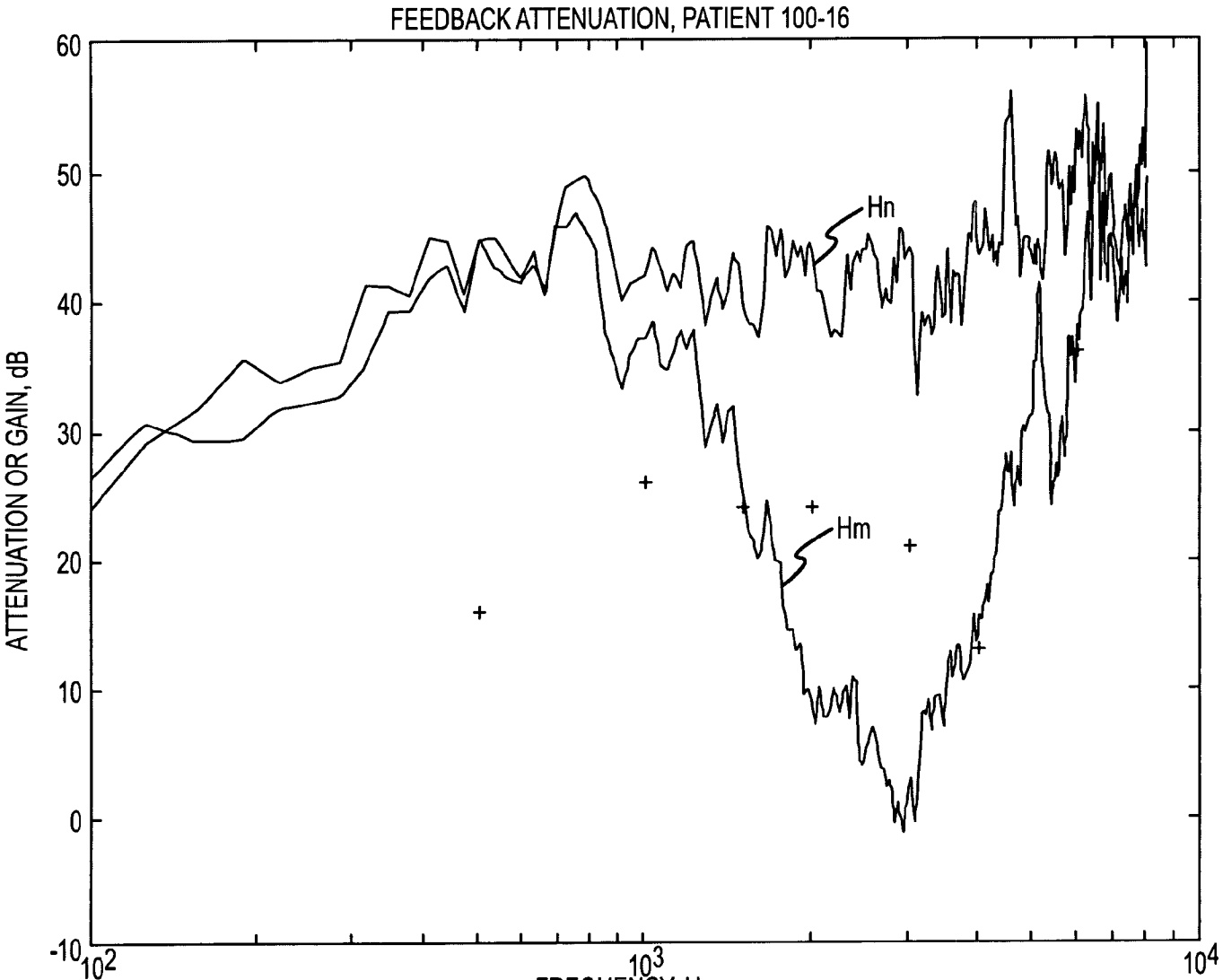
FIG. 10 is a plot of available gains for cancelled and non-cancelled outputs of an implanted microphone.

FIG. 9 further illustrates a canceled signal or net output response Hn. As shown, once the filtered motion sensor output response Haf is removed from the microphone output response Hm, the resulting net response signal Hn is spaced in relation to the MLS drive signal over the frequency range between 100 Hz and 8,000 Hz. Specifically, where significant feedback existed between about 1200 Hz and about 5200 Hz, the net output response Hn is markedly improved. Accordingly, a significant gain may be applied to the net output response signal Hn. For instance, as shown in FIG. 10, the available gain for the net response signal Hn signal varies between about 25 and about 40 dB over the frequency range between about 1200 Hz and about 5000 Hz. In contrast, little or no gain can be applied to the microphone output response Hm over portions of the same frequency range without resulting in crossover and thereby system oscillation. Accordingly, more gain may be applied to the net output response Hn over a desired frequency range such the signal may be better amplified. Accordingly, cancellation may allow for amplification of low amplitude acoustic signals of ambient origin that are present in the microphone output Hm. Accordingly, these low amplitude signals may be perceived as sound by a user of the implanted hearing instrument.

Further, the available gain may be utilized as a threshold determining the effectiveness of the digital filter. If the available gain over all or part of a desired frequency range (e.g., an auditory hearing range) meets or exceeds the threshold determination (e.g., 20 dB at all frequencies), the selected model and the corresponding digital filter may be, for example, stored to permanent memory of the hearing system. Alternatively, if a desired gain is not achieved, the process may be repeated. For instance, different transducer drive signals may be utilized to generate a different set of output responses for the microphone and motion sensor which may again be utilized to generate a system model.

A number of different digital filters may be utilized to model the ratio of the microphone and motion sensor output responses. Such filters may include, without limitation, LMS filters, max likelihood filters, adaptive filters and Kalman filters. Two commonly utilized digital filter types are finite impulse response (FIR) filters and infinite impulse response (IIR) filters. Each of the types of digital filters (FIR and IIR) possess certain differing characteristics. For instance, FIR filters are unconditionally stable. In contrast, IIR filters may be designed that are either stable or unstable. However, IIR filters have characteristics that are desirable for an implantable device. Specifically, IIR filters tend to have reduced computational requirements to achieve the same design specifications as an FIR filter. As will be appreciated, implantable device often have limited processing capabilities, and in the case of fully implantable devices, limited energy supplies to support that processing. Accordingly, reduced computational requirements and the corresponding reduced energy requirements are desirable characteristics for implantable hearing instruments. In this regard, it may be advantageous to use an IIR digital filter to remove the effects of feedback and/or biological noise from an output response of an implantable microphone.

The following illustrates one method for modeling a digital output of an IIR filter to its digital input, which corresponds to mechanical feedback of the system as measured by a motion sensor. Accordingly, when the motion sensor output response Ha is passed through the filter, the output of filter, Haf, is substantially the same as the output response Hm of the implanted microphone to a common excitation (e.g., feedback, biological noise etc.). The current input to the digital filter is represented by x(t) and the current output of the digital filter is represented by y(t). Accordingly, a model of the system may be represented as:

$$y(t)=B(z)/A(z)x(t)+C(z)/D(z)\epsilon(t) \qquad \text{Eq. 1}$$

In this system, B(z)/A(z) is the ratio of the microphone output response (in the z domain) to the motion sensor output response (in z domain), x(t) is the motion sensor output, and y(t) is the microphone output. The motion sensor output is used as the input x(t) because the intention of the model is to determine the ratio B/A, as if the motion sensor output were the cause of the microphone output. $\epsilon(t)$ represents independently identically distributed noise that is independent of the input x(t), and might physically represent the source of acoustic noise sources in the room and circuit noise. $\epsilon$ is colored by a filtering process represented by C(z)/D(z), which represents the frequency shaping due to such elements as the fan housing, room shape, head shadowing, microphone response and electronic shaping. Other models of the noise are possible such as moving average, autoregressive, or white noise, but the approach above is most general and is a preferred embodiment. A simple estimate of B/A can be performed if the signal to noise ratio, that is the ratio of (B/A x(t))/(C/D $\epsilon$(t)) is large, by simply ignoring the noise. Accordingly, the only coefficients that need to be defined are A and B. As will be appreciated for an IIR filter, one representation of the general digital filter equation written out is:

$$y(t)=b_o t+b_1 x(t-1)+b_2 x(t-2)+\ldots b_p x(t-p)-a_1 y(t-1)-a_2 y(t-2)-\ldots a_q y(t-q) \quad \text{Eq. 2}$$

where p is the number of coefficients for b and is often called the number of zeros, and q is the number of coefficients for a and is called the number of poles. As it can be seen, the current output y(t) depends on the q previous output samples {y(t−1), y(t−2), . . . y(t−q)}, thus the IIR filter is a recursive (i.e., feedback) system. The digital filter equation give rise to the transfer function:

$$H(z)=\frac{(b_0+b_1 z^{-1}+b_2 z^{-2}+\ldots b_p z^{-p})}{(1+a_1 z^{-1}+a_2 z^{-2}+\ldots a_q z^{-q})} \quad \text{Eq. 3}$$

in the z domain, or $$H(\omega)=\frac{(b_0+b_1 e^{-i\omega}+b_2 e^{-2i\omega}+\ldots b_p e^{-pi\omega})}{(1+a_1 e^{-i\omega}+a_2 e^{-2i\omega}+\ldots a_q e^{-qi\omega})} \quad \text{Eq. 4}$$

in the frequency domain.

Different methods may be utilized to select coefficients for the above equations based on the ratio(s) of the responses of the microphone output response to the motion sensor output response as illustrated above in FIGS. 7 and/or 8. Such methods include, without limitation, least mean squares, Box Jenkins, maximum likelihood, parametric estimation methods (PEM), maximum a posteriori, Bayesian analysis, state space, instrumental variables, adaptive filters, and Kalman filters. The selected coefficients should allow for predicting what the output response of the microphone should be based on previous motion sensor output responses and previous output responses of the microphone. The IIR filter is computationally efficient, but sensitive to coefficient accuracy and can become unstable. To avoid instability, the order of the filter is preferably low, and it may be rearranged as a more robust filter algorithm, such as biquadratic sections, lattice filters, etc. To determine stability of the system, A(0) (i.e., the denominator of the transfer function) is set equal to zero and all pole values in the Z domain where this is true are determined. If all these pole values are less than one in the z domain, the system is stable. Accordingly, the selected coefficients may be utilized for the filter.

However, even where the poles are less than one in the Z domain, the output of the filter may, in some instances, saturate and become nonlinear. In such instance, the poles may shift, which may result in instability. Accordingly, it may be desirable to monitor y(t) to identify when the system has become nonlinear and hence potentially unstable. Upon such identification, the stored earlier output vector {y(t−1), y(t−2), . . . y(t−q)} may be reset to zero (or some other suitable initial value, such as the mean) to restore stability to the system. This may result in a short time period while the filter reestablishes a series of previous output values. Accordingly, the output of the filter may not match the output response of the microphone while the filter reestablishes the filter coefficients. This is normally a very short transient and is not normally perceptible.

To provide a more stable system, the IIR filter may be implemented in cascading bi-quad sections. Specifically, it has been determined that for most situations, a sixth order zero/sixth order pole IIR filter is effective to match the motion sensor output response to the microphone output response. Often, a fourth order IIR filter is sufficient. The sixth order IIR filter may be rewritten into sequentially implementing (i.e., cascading) bi-quad sections with appropriate coefficients rather than using the direct form (i.e, sixth order) implementation. For instance, a sixth order transfer function:

$$H(t)=\frac{(b_0+b_1 z^{-1}+b_2 z^{-2}+\ldots b_6 z^{-6})}{(1+a_1 z^{-1}+a_2 z^{-2}+\ldots a_6 z^{-6})} \quad \text{Eq. 5}$$

may be factored as:

$$H(t)=\frac{(b_{01}+b_{11}z^{-1}+b_{21}z^{-2})(b_{02}+b_{12}z^{-1}+b_{22}z^{-2})\ldots(b_{06}+b_{16}z^{-1}+b_{26}z^{-2})}{(1+a_{11}z^{-1}+a_{12}z^{-2})(1+a_{12}z^{-1}+a_{22}z^{-2})\ldots(1+a_{16}z^{-1}+a_{26}z^{-2})} \quad \text{Eq. 6}$$

where the b01, b11, etc. coefficients result from factoring the numerator, and the a11, a21, etc., coefficients result from factoring the denominator. Each group of numerator and denominator are one biquad section; multiplying them as above is the equivalent of cascading the sections (connecting them in sequence). These bi-quad sections can be scaled separately and then cascaded in order to minimize recursive accumulation error. Accordingly, as each bi-quad section represents a two-pole two-zero transfer function, a more stable system is achieved as compared to a six pole six zero transfer function.

The above methods may be utilized to select a set of filter coefficients based on a first inserted signal the results in generating feedback at the motion sensor 70 and microphone 10. However, it may in some instances be desirable to select additional sets of filter coefficients for different inserted signals. These different inserted signals may correspond to different expected operating conditions. For instance, a first set of filter coefficients may be determined for low noise environments (e.g., a library setting), a second set of filter coefficients may be determined for moderate noise environments (e.g., normal conversation) and a third set of filter coefficients may be determined for high noise environments (e.g., a public gather such as a sporting event). Further, the system may be operative to monitor one or more parameters (e.g., in the microphone output response Hm and/or the motion sensor output response Ha) in order to selectively switch between and/or extrapolate between different sets of coefficients based on current usage conditions. In this regard, the filter may be an adaptive filter. Such an adaptive filter may be continuously adjustable rather than discretely adjustable (e.g., between different coefficient sets), as well as automatically adaptive.

To provide such adaptive properties, the system may be operative to store or otherwise at least first and second sets of values (e.g., coefficients). More preferably, the system is operative to store a plurality of such values. For instance, in one arrangement, the system may utilize information stored in a look-up table. Accordingly, different values may be selected from tabulated values of the look-up table information based on, for instance, one or both of the output responses of the microphone and motion sensor. Further, the system may be operative to interpolate between different sets of tabulated values. In this regard, the system may include interpolation functionality. Further, each stored value may comprise a function that is appropriate for a current usage condition.

By generating a filter that manipulates the motion sensor output response Ha to substantially match the microphone output response Hm for mechanical feedback (e.g., caused by a known inserted signal), the filter will also be operative to manipulate the motion sensor output response Ha to biological noise to substantially match the microphone output Hm response to the same biological noise. That is, the filter is operative to at least partially match the output responses Ha and Hm for any common stimuli. However, this may result in the generation of increased electrical noise in the system. As will be appreciated, all electrical components (e.g., the microphone 10 and motion sensor 70) generate electrical noise during their operation. Further, as amplification/gain is generally applied to the motion sensor output Ha in order to match the output response Hm of the microphone 10, the electrical noise of motion sensor 70 is likewise amplified. For instance, if 6 dB of gain is applied to the motion sensor output response Ha, the 6 dB of gain is also applied to the electrical noise of the motion sensor 70. Unfortunately, the variance of the electrical noise of the motion sensor is additive to the variance of the electrical noise of the microphone 10. That is, the electrical noise of these components do not cancel out. Accordingly, in some instances, the use of the motion sensor output may add noise to the system. Specifically, when little biological noise is present, the use of a motion sensor output response to cancel transducer feedback may increase the total noise of the implanted hearing system. If the noise floor is high enough, the electrical noise of the system may encroach on soft speech sounds, reducing speech intelligibility of a user of the implanted hearing system.

Figure 11:
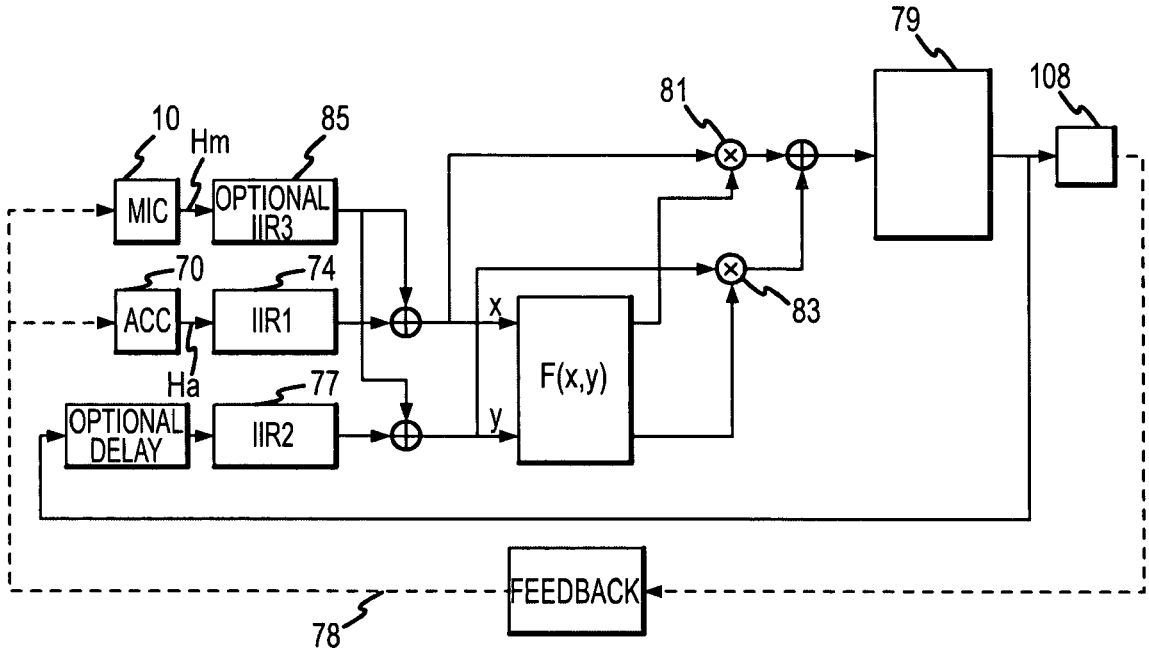
FIG. 11 is a schematic illustration of an implantable microphone that incorporates two control loops for controlling undesired signals.

FIG. 11 schematically illustrates an implanted hearing system that is operative to selectively switch between and/or blend first and second 'control loops' to control transducer feedback and/or biological noise, while minimizing electronic noise. More specifically, the system is operative to select an amount a between a first control loop that is operative to reduce transducer feedback and biological noise and an amount $(1-\alpha)$ from a second control loop that is operative to reduce only transducer feedback utilizing a second filter (e.g., IIR2). Note that while the filters are shown in this preferred embodiment as IIR filters, this is not meant to limit the implementation. In this regard, the first control loop utilizes a motion sensor 70 and a filter 74 to match the output response Ha of the motion sensor 70 to the output response Hm of the microphone assembly 10. In this regard, the operation of the first control loop is substantially similar to the system discussed in relation to FIGS. 5-10 where the response of a motion sensor 70 is scaled and/or frequency shifted (i.e., filtered) and removed from the response of the microphone 10. In contrast, the second control loop is an internal feedback loop where the digital output of the signal processor 79 of the hearing instrument is inserted back to the input of the signal processor 79 via a digital filter 77.

Generally, the second control loop eliminates feedback from the input to the processor by providing an additional feedback loop of the same magnitude but opposite phase through a second path. That is, in addition to feedback through a tissue feedback path 78, the digital output of the hearing aid signal processor 79 is inserted back to the input via a digital filter 77 (i.e., through the internal control loop). A number of different control structures for adjusting the parameters of this digital filter are known in the signal processing arts. The thrust of all of these control structures is to make the internal loop (i.e., the digital filter 77) act as a good model of the external feedback loop 78. Subtracting the filtered internal loop feedback (i.e., the model) from the microphone output response Hm (which contains a desired signal and mechanical feedback) results in the desired signals being passed on for further processing substantially free of mechanical feedback. The advantages of this type of internal loop are 1) Simplicity—no additional sensors are used and 2) low noise as the digital signal output signal is never converted into an analog signal prior to being filtered and reinserted into the signal processor 79. The only noise introduced into the system is from the electrical noise of the microphone and quantization noise. The main disadvantage of the second control loop implementation is that all undesired signals in the microphone output response originating outside of the implanted system cannot be eliminated. This includes biological noises. However, it will be appreciated at times when little biological noise is present, the second control loop may introduce less electrical noise into the system. That is, in contrast to the first control loop, which applies gain to the electrical noise of the motion sensor and which further include the electrical noise of the microphone, the second control loop introduces only the electrical noise of the microphone.

The inability of the internal control loop to reject biological noise may result in uncomfortably loud and even saturating signals during, for instance, chewing. Similarly, the increased noise level of the first control loop utilizing the motion sensor is at times a disadvantage as it may cause an increase in the hearing threshold of the patient and/or necessitate the use of additional signal processing to remove excess noise. The embodiment of FIG. 11 reduces these problems by combining the techniques of the two control loops based on current needs of the system. For instance, when higher magnitude ambient sound signals are present, the added electrical noise from the first control loop may be unnoticeable if the electrical noise is small compared to the ambient sound signals (e.g., over a desired frequency band). Accordingly, the first control loop may be utilized in such conditions. Alternatively, where the electrical noise level is large compared to ambient sound signals it may be preferable to utilize the second control loop. However, it will be appreciated that if biological noise is present, the first control loop may provide a lower noise level.

Accordingly, a method to blend between the outputs x and y of the first and second control loops is provided. As shown, the motion sensor 70 (e.g., accelerometer) detects the acceleration of the microphone, and the output of motion sensor Ha is filtered by a first filter 74 (e.g., IIR1) to model the motion sensor output response Ha to the microphone output response Hm. This forms the first control loop. The output of the hearing system processor 79 (which includes the usual hearing instrument functions as required such as compression, channelization and equalization) is filtered by a second filter 77 (e.g., IIR2) to model the microphone output response to the signal processor output. This forms the second or intern control loop. Each of the filtered signals is subtracted from the microphone signal, resulting in a first control loop signal x and a second control loop signal y. Both of these signals x and y typically have reduced mechanical feedback in comparison to the microphone output. The first control loop output x, and the internal control loop output y, then go to the function block F(x,y). This block determines how much of each of the first and second signals x and y to use, respectively $\alpha$ and $1-\alpha$, which are then passed to the two multipliers 81, 83 and summed by a summation device 87. This summed signal forms the input of the processor 79.

The key to the operation of the device is the performance of F(x,y). This block determines how much of each signal x and y to use. In one arrangement, the function block simply determines which of the two cancelled signals x and y has less power, and hence less noise. In this arrangement if there is no biological noise, F(x,y) would put out $\alpha=0$ and $1-\alpha=1$, since x will contain the additional electrical noise of the motion sensor, and therefore will be noisier than y. If, on the other hand, there is significant biological noise, the block F(x,y) would put out $\alpha=1$ and $1-\alpha=0$, since x will have the biological noise removed, and therefore will be quieter than y. As a result, the processor 79 is given whichever signal x or y has the lower noise. In this case, the multipliers 81, 83 can be replaced with switches to simply route x or y appropriately.

In further arrangements, $\alpha$ and $1-\alpha$ can be continuous variables rather than just logical 1 and 0, and F(x,y) can chose a mixing ratio between the two. F(x,y) can then be a computed sigmoid or looked up in a table. Such an embodiment may operate on subbands, with the subtracted values, F(x,y), and the multiplications being performed in subband domain and therefore making sure every subband used is selected to have the least noise.

The optional third filter 85 (e.g., IIR3) may be used to remove the poles and zeros of the microphone acceleration response from the first and second filters IIR1 and IIR2, thus reducing their complexity. The optional time delay is used to model any simple time delay component of the feedback, which otherwise would simply additional parameters in the filter. Since time delays can be implemented more efficiently as a separate structure, this approach reduces the complexity of the system.

Figure 12:
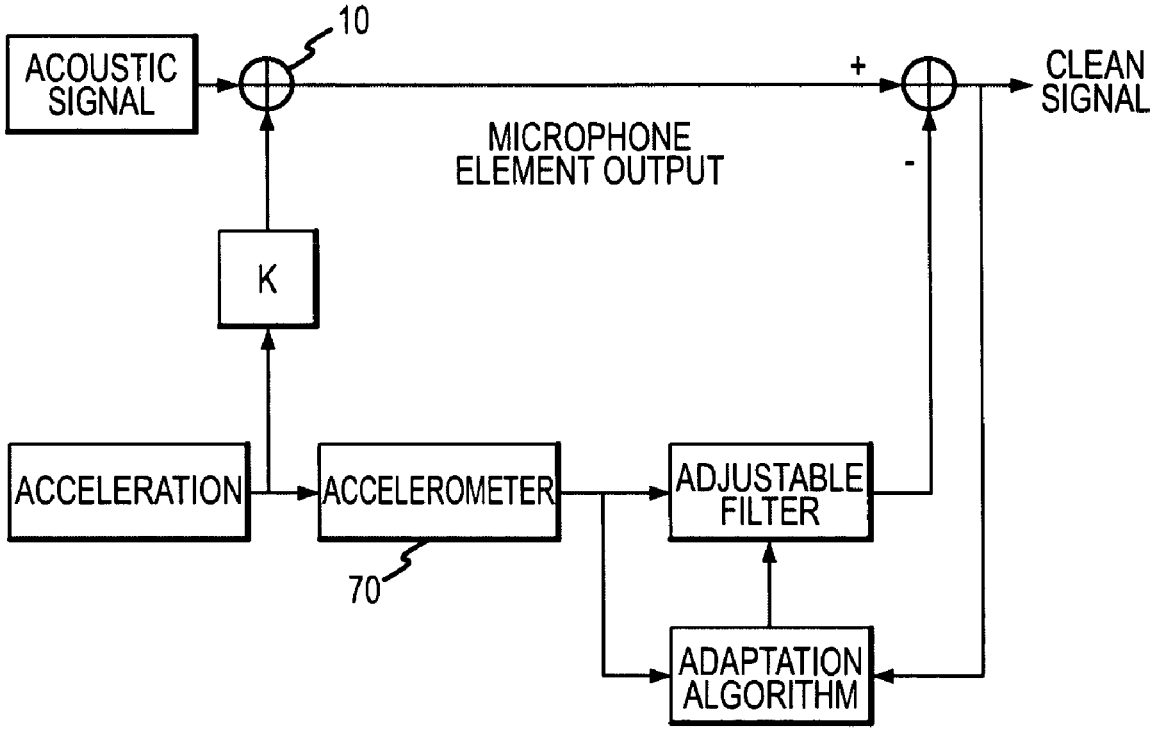
FIG. 12 illustrates use of an adaptive filter algorithm for noise cancellation.

In another arrangement, the effects of biological noise can be reduced and/or removed by using adaptive filtering techniques. See for instance, "Adaptive Filter Theory" by Simon Haykin. An illustrative (but not limiting) system is illustrated in FIG. 12. The biological noise is modeled by the acceleration at the microphone assembly filtered through a linear process K. This signal is added to the acoustic signal at the surface of the microphone element. In this regard, the microphone 10 sums the signals. If the combination of K and the acceleration are known, the combination of the accelerometer output and the adaptive/adjustable filter can be adjusted to be K. This is then subtracted out of the microphone output at point. This will result in the cleansed or net audio signal with a reduced biological noise component. This net signal may then be passed to the signal processor represented in FIG. 3 by G, where it can be processed by the hearing system.

Adaptive filters can perform this process using the ambient signals of the acceleration and the acoustic signal plus the filtered acceleration. As well-known to those skilled in the art, the adaptive algorithm and adjustable filter can take on many forms, such as continuous, discrete, finite impulse response (FIR), infinite impulse response (IIR), lattice, systolic arrays, etc.,—see Haykin for a more complete list—all of which have be applied successfully to adaptive filters. Well-known algorithms for the adaptation algorithm include stochastic gradient-based algorithms such as the least-mean-squares (LMS) and recursive algorithms such as RLS. There are algorithms which are numerically more stable such as the QR decomposition with RLS (QRD-RLS), and fast implementations somewhat analogous to the FFT. The adaptive filter may incorporate an observer, that is, a module to determine one or more intended states of the microphone/motion sensor system. The observer may use one or more observed state(s)/variable(s) to determine proper or needed filter coefficients. Converting the observations of the observer to filter coefficients may be performed by a function, look up table, etc. Adaptive algorithms especially suitable for application to lattice IIR filters may be found in, for instance, Regalia. Adaptation algorithms can be written to operate largely in the DSP "background," freeing needed resources for real-time signal processing.

Figure 13:
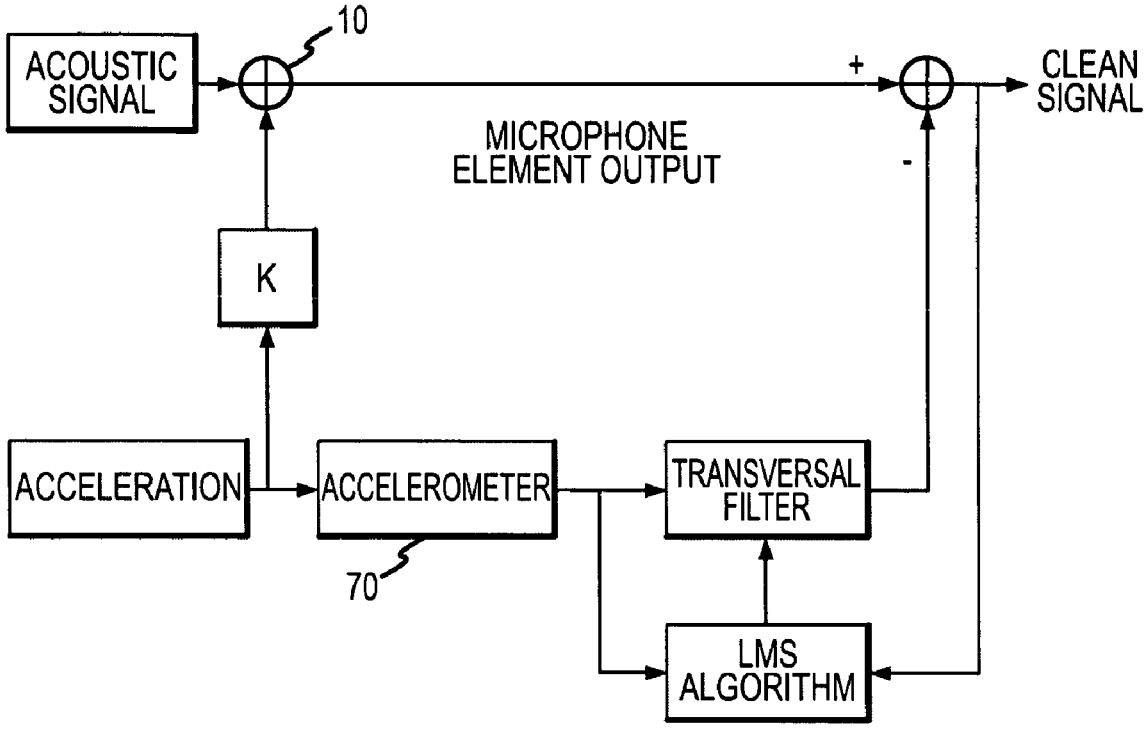
FIG. 13 illustrates another embodiment of adaptive filter for removing noise arising from acceleration.

FIG. 13 illustrates an embodiment where a LMS is implemented using a transversal filter and an LMS update algorithm. One common form of the LMS algorithm works by correlating the clean signal with the input vector (that is, the time-delayed image of the input) to the transversal filter. This correlation at a given tap will be positive if the transversal filter tap coefficient ("weight") needs to be increased, and negative if the transversal filter weight needs to be reduced. By adding the correlation, times a positive gain factor delta, every time step to an existing weight, the weight will gradually change over time. If the delta is set to be small enough, the time constant of this adjustment process will be long compared to the duration of phonemes and syllables composing speech. Speech will be therefore be unaffected, but unwanted signals that are correlated to acceleration will be filtered out.

An adaptive filtering process with an accelerometer can be used to filter out a significant portion of the feedback signal as well. In this case, the accelerometer picks up the unwanted feedback, and the adjustable filter is driven to essentially remove it. Thus, the actions of both determining H and removing its contribution are performed in the adaptive filter. This situation is somewhat different from the case of biological noise, in that for many types of biological noise, such as teeth grinding, the acceleration is essentially uncorrelated with the desired acoustic signals, and will be readily removed. The feedback signal, on the other hand, is correlated with the acoustic signal, in that it represents the equalization, compression, amplification, etc., of the acoustic signal, and hence has a very high degree of correlation with the input.

Certain biological signals also are more highly correlated with the input, such as the patients own speech. In this case, there will be an acoustic signal that is nearly perfectly correlated with the output of the accelerometer. That is, tissue borne vibrations caused by a patient's own speech will be received by the accelerometer thereby resulting in an accelerometer output that is correlated to the received acoustic signal. Adaptation to remove this correlated signal (i.e. remove the patient's own speech spectrum) will also result in adaptation to remove the speech spectrum of the population at large, and hence is very undesirable. It is possible to identify highly correlated signals (that is, output signals from the microphone and motion sensor/accelerometer having a correlation close to 1) and remove their effects. One way is that when the correlation is close to 1, the value of delta can be decreased, so that the time constant for adaptation is increased. Delta may be set to zero during these times, delta may be made a function of the correlation (e.g., delta is proportional to 1-Mag (correlation)), or the algorithm instructed simply to skip updating the weights during times when correlation is close to 1. These methods may be combined. It is also possible to detect the presence of speech using well-known algorithms such as voice activity detection (VAD), and prevent adaptation from taking place during those times.

Other issues which require the control of the weights can be used as a form of error correction. It is expected that the adaptive filter weight vector will be set to an initial value before the adaptation process starts. This initial value is selected in order to minimize the hunting of the filter. Such hunting can cause the process to take a long time to stabilize or even prevent finding a suitable optimum. During the time period when the weights are not close to optimum, the sound to the patient will sound "distorted." An initial value can be set using a system identification process as described above. If this is done in the research laboratory/factory, the "factory initial values" could be place directly into the algorithm and fixed for all devices. A better initial value would be to allow the adaptation to occur under controlled conditions, such as with the gain and equalization within controlled limits, either at the time of implantation, or during the first fitting. The factory initial values can still be used as an initial value for the beginning of this second process. However, once the step of the fitting takes place, a new initial value could be used whenever the user "turns on" (that is, starts normal signal processing operation) the implant. It is also possible to use the last weight values as the new initial values whenever the implant is "turned on."

The original factory initial value, or a more refined second stage initial value vector acquired by the surgeon or audiologist can be used to perform error checking on the rest of the algorithm. For instance, the weight values should always stay within a certain distance/range of the initial values (in n-space, as measured by any one of many distance functions, such as Euclidian or Manhattan norms). If the system ever attempts to set the values beyond this range during normal operation, a limiting function can prevent the values/weights from moving any farther away from the original initial value setting. That is, the values may be maintained within a predetermined range. If the system attempts to set the values at a distance beyond the specified range, it may indicate something is wrong with the device or the patient. Such occurrences could indicate, for instance, the failure of the accelerometer, or changes in the fixturing of the device. If the weight values vector is requested to change rapidly or by too large a magnitude, this also indicates that something, perhaps overly noisy inputs, is wrong. Various methods of limiting, such as slew rate limiting or preventing updates if the weight changes are too large, can be used.

The microphone assembly 10 and accelerometer can both have frequency shaping (including phase shifts). The simpler the response from the microphone assembly 10 and accelerometer, the simpler and more stable an adaptive filter system and/or system identification process is expected to be. Generally, the microphone will be at least second order in the audio range of interest. While it is not required in theory that the accelerometer have the same order as the microphone to get cancellation using system identification or adaptive filtering, in practice, biological noise such as the patient's speech may cause the microphone output channel to saturate. This can be avoided by approximately matching the performance of the microphone assembly and accelerometer acceleration sensitivities and subtracting electronically. This difference signal then can be amplified in order to get a suitable acoustic signal with less likelihood of saturation, while the techniques described above such as adaptive filtering can now be applied to the amplified difference and an attenuated accelerometer output.

Those skilled in the art will appreciate variations of the above-described embodiments that fall within the scope of the invention. For instance, sub-band processing may be utilized to implement filtering of different outputs. As a result, the invention is not limited to the specific examples and illustrations discussed above, but only by the following claims and their equivalents.

The invention claimed is:

1. A method for use in an implantable hearing system for generating a system model to match an output response of a motion sensor to at least a portion of an output response of an implanted microphone, comprising:

operating an implanted auditory stimulation device;

first sampling a microphone output response of an implanted microphone during operation of said implanted auditory stimulation device;

second sampling a motion sensor output response of a motion sensor during operation of said implanted auditory stimulation device; and generating a system model of a relationship of said microphone output response and said motion sensor output response.

2. The method of claim 1, further comprising:

utilizing said system model to alter at least a first characteristic of subsequent motion sensor output responses thereby generating altered motion sensor output responses.

3. The method of claim 2, further comprising:

combining said altered motion sensor output responses with microphone output responses to generate combined output responses.

4. The method of claim 3, wherein combing comprises subtracting said altered motion sensor output responses from said microphone output responses to generate net output responses.

5. The method of claim 1, wherein generating said system model comprises generating a model of ratios of said output responses.

6. The method of claim 5, wherein said model of ratios is generated for a plurality of ratios of said output responses at a plurality of different frequencies.

7. The method of claim 5, wherein said model of ratios comprises a mathematical function approximating said plurality of ratios.

8. The method of claim 7, wherein said mathematical function comprises an IIR filter function.

9. The method of claim 8, further comprising:

implementing said IIR filter function as an IIR digital filter to alter subsequent motion sensor output responses, thereby generating filtered motion sensor output responses.

10. The method of claim 9, further comprising:

combining said filtered motion sensor output responses from microphone output responses to generate combined output responses.

11. The method of claim 10, wherein combining comprises subtracting said filtered motion sensor output responses from said microphone output responses.

12. The method of claim 9, further comprising:

monitoring said IIR digital filter for instability.

13. The method of claim 12, wherein upon identifying instability of said IIR digital filter, resetting coefficients of said IIR digital filter to predetermined values.

14. The method of claim 1, wherein said first sampling and said second sampling are performed for a common time period.

15. The method of claim 14, wherein said first and second sampling are performed simultaneously.

16. The method of claim 1, wherein said first and second sampling each comprise taking a plurality of data samples for each said output response.

17. The method of claim 16, further comprising:

transforming said data samples to generate frequency domain data, wherein said frequency domain data is utilized to generate said system model.

18. The method of claim 16, wherein said generating step further comprises:

transcutaneously transmitting said plurality of data samples form an implanted sampling device to an external processing device.

19. The method of claim 18, wherein said system model is generated by said external processing device.

20. The method of claim 19, further comprising:

transcutaneously transmitting said system model from said external processor to an implanted storage device.

21. The method of claim 16, wherein said plurality of data samples are taken for a desired frequency range.

22. The method of claim 21, wherein said desired frequency range is between about 0 Hz and about 10,000 Hz.

23. The method of claim 21, wherein said desired frequency range is between about 100 Hz and about 8000 Hz.

24. The method of claim 1, wherein operating said implanted auditory stimulation device further comprises:

providing a known signal to said implanted auditory stimulation device.

25. The method of claim 24, wherein said known signal is provided transcutaneously.

26. The method of claim 25, wherein said known signal is provided from an implanted memory structure associated with said implanted auditory stimulation device.

27. The method of claim 25, wherein providing said known signal comprises providing a maximum length sequence (MLS) signal.

28. The method of claim 1, wherein operating said implanted auditory stimulation device comprises operating an electromechanical transducer for mechanical stimulation of one of a middle ear auditory component and an inner ear auditory component.

29. A method for use in an implantable hearing system for generating a system model to match an output response of a motion sensor to at least a portion of an output response of an implanted microphone, comprising:

measuring, in response to a common stimulation, first and second output responses of an implanted microphone and a motion sensor, respectively;

generating a relationship model of said first and second output responses; and implementing said relationship model as a filter to adjust subsequent output responses of one of said implanted microphone and said motion sensor.

30. The method of claim 29, further comprising:

generating ratio information associated with ratios of the first and second output response; and utilizing said ratio information to generate said relationship model.

31. The method of claim 30, further comprising:

transforming said first and second output responses to produce first and second frequency domain responses, respectively, and utilizing said frequency domain responses to generate said relationship model.

32. The method of claim 30, wherein generating a relationship model comprises fitting a digital filter function to said ratio information over a predetermined frequency range.

33. The method of claim 31, further comprises selecting a first set of coefficients for said digital filter function, wherein said first set of coefficients correspond to a first relationship model of said first and second output responses to a first common stimulation.

34. The method of claim 32, further comprising, selecting at least a second set of coefficients for said digital filter function, wherein said at least a second set of coefficients correspond to a second relationship model of said first and second output responses to at least a second common stimulation.

35. The method of claim 34, further comprising:

adaptively selecting between available sets of filter coefficients based on current operating conditions of said implantable hearing system.

36. A method for use in an implantable hearing system for matching an output response of a motion sensor to at least a portion of an output response of an implanted microphone, comprising:

measuring first and second outputs of an implanted microphone and a motion sensor, respectively, in response to the operation of an implanted auditory stimulation device;

using said first and second outputs to generate a digital filter indicative of a relationship of frequency responses of the implanted microphone and the motion sensor; and implementing said digital filter to filter subsequent outputs of said motion sensor to produce filtered outputs.

37. The method of claim 36, wherein:

said first output measures feedback transmitted through a first tissue path between said implanted auditory stimulation device and said implanted microphone; and said second output measures feedback transmitted through a second tissue path between said implanted auditory stimulation device and said motion sensor.

38. The method of claim 37, wherein said first and second tissue paths are substantially the same tissue path.

39. The method of claim 36, further comprising:

removing said filtered outputs from subsequent outputs of said implanted microphone.

40. The method of claim 36, further comprising:

operating said implantable auditory stimulation device in response to a known drive signal, wherein said first and second outputs are measured during operation of said implantable auditory stimulation device in response to said known drive signal.

41. A method for use in an implantable hearing system for generating a system model to match an output response of a motion sensor to at least a portion of an output response of an implanted microphone, comprising:

measuring first and second output responses of an implanted microphone and a motion sensor, respectively, to a common stimulation source;

generating a first and second ratios of the first output responses to the second output responses for first and second frequency ranges, respectively;

utilizing said first and second ratios to adjust subsequent output responses of said motion sensor for said first and second frequency ranges, respectively.

42. The method of claim 41, further comprising:

generating a plurality of ratios of the first output responses to the second output responses for a corresponding plurality of frequency ranges.

43. The method of claim 41, wherein utilizing said ratios to adjust subsequent output responses comprises:

using said ratios to substantially match said subsequent output responses of said motion sensor, in response to a stimuli, to subsequent output responses of said implanted microphone to said stimuli.

44. The method of claim 43, wherein after adjustment, said subsequent output responses of said motion sensor are removed from said subsequent responses of said implanted microphone.

45. The method of claim 41, wherein generating said ratios comprises a sub-band processing of said first and second output responses.

46. An implantable hearing system operative to match an output response of a motion sensor to at least a portion of an output response of an implanted microphone for noise cancellation purposes, comprising:

a microphone adapted for subcutaneous positioning and being operative to receive signals including motion and acoustic components and generate microphone output responses;

a motion sensor operative to receive signals including motion components and generate a motion sensor output responses;

a digital filter adapted to utilize a ratio of said microphone output responses and said motion sensor output responses to generate a transfer function, wherein said digital filter is operative to apply said transfer function to said motion sensor output responses to produce filtered motion sensor output responses; and a summation device for combining said filtered motion sensor output responses and said microphone output responses and generating a net output response, an implantable auditory stimulation device operative to stimulate an auditory component of a patient in accordance with said net output response.

47. The system of claim 46, wherein said digital filter comprises an IIR digital filter.

48. The system of claim 46, further comprising:

a digital signal processor, wherein said digital signal processor receives said net output response and further processes said not output response prior to said net output response being provided to said implantable auditory stimulation device.

49. The system of claim 46, wherein said auditory stimulation device comprises a mechanical actuator for physically stimulating said auditory component.

* * * * *